US005879192A

United States Patent [19]

Machida et al.

[11] Patent Number: 5,879,192

[45] Date of Patent: Mar. 9, 1999

[54] ELECTRICAL CONNECTOR

[75] Inventors: Yukifumi Machida; Hideo Kon; Yoshikazu Tanaka; Akihiro Kojima; Michiyasu Watanabe, all of Tokyo, Japan

[73] Assignee: Ryosei Electro-Circuit Systems Ltd., Tokyo, Japan

[21] Appl. No.: 718,387

[22] PCT Filed: Jan. 31, 1996

[86] PCT No.: PCT/JP96/00186

§ 371 Date: Oct. 1, 1996

§ 102(e) Date: Oct. 1, 1996

[87] PCT Pub. No.: WO96/24176

PCT Pub. Date: Aug. 8, 1996

[30] Foreign Application Priority Data

| | | | |
|---|---|---|---|
| Feb. 1, 1995 | [JP] | Japan | 7-037548 |
| May 24, 1995 | [JP] | Japan | 7-149455 |
| Jun. 9, 1995 | [JP] | Japan | 7-168046 |

[51] Int. Cl.[6] ..... H01R 13/516

[52] U.S. Cl. ..... 439/598; 439/752

[58] Field of Search ..... 439/598, 686, 439/695, 701, 752

[56] References Cited

U.S. PATENT DOCUMENTS

| | | | |
|---|---|---|---|
| 4,753,613 | 6/1988 | Morgan | 439/752 |
| 4,944,696 | 7/1990 | Sveyoshi et al. | 439/598 |
| 5,100,345 | 3/1992 | Endo et al. | 439/752 |
| 5,145,419 | 9/1992 | Yamanashi et al. | 439/752 |
| 5,458,511 | 10/1995 | Sakai et al. | 439/152 |
| 5,618,207 | 4/1997 | Marjima | 439/752 |

*Primary Examiner*—Paula Bradley
*Assistant Examiner*—Tho Dac Ta
*Attorney, Agent, or Firm*—Varndell Legal Group

[57] ABSTRACT

An electric connector including a housing (14) and a rear holder (13). The rear holder (13) retains connecting terminals (12) therein and is fitted into the housing (14) from the rear of the housing. The rear holder (13) includes a front retaining portion (36*a*, 36*b*) for restricting forward movement of the connecting terminals (12), and a rear retaining portion (37) for restricting backward movement of the connecting terminals (12). The housing (14) has an inclined guide surface (34*b*, 43*c*) for receiving and guiding a respective connecting terminal (12) at an inclined angle into the housing. The structure of the housing (14) and rear holder (13) is adapted so that the connecting terminals (12) are retained within a terminal connecting portion (21) in a provisionally engaged position by inserting a connecting terminal (12) into the housing (14) at an inclined by abutting the inclined guide surface (34*b*, 43*c*) and then moving the connecting terminals (12) into a fixed completely engaged horizontal position by pushing the rear holder (13).

9 Claims, 24 Drawing Sheets

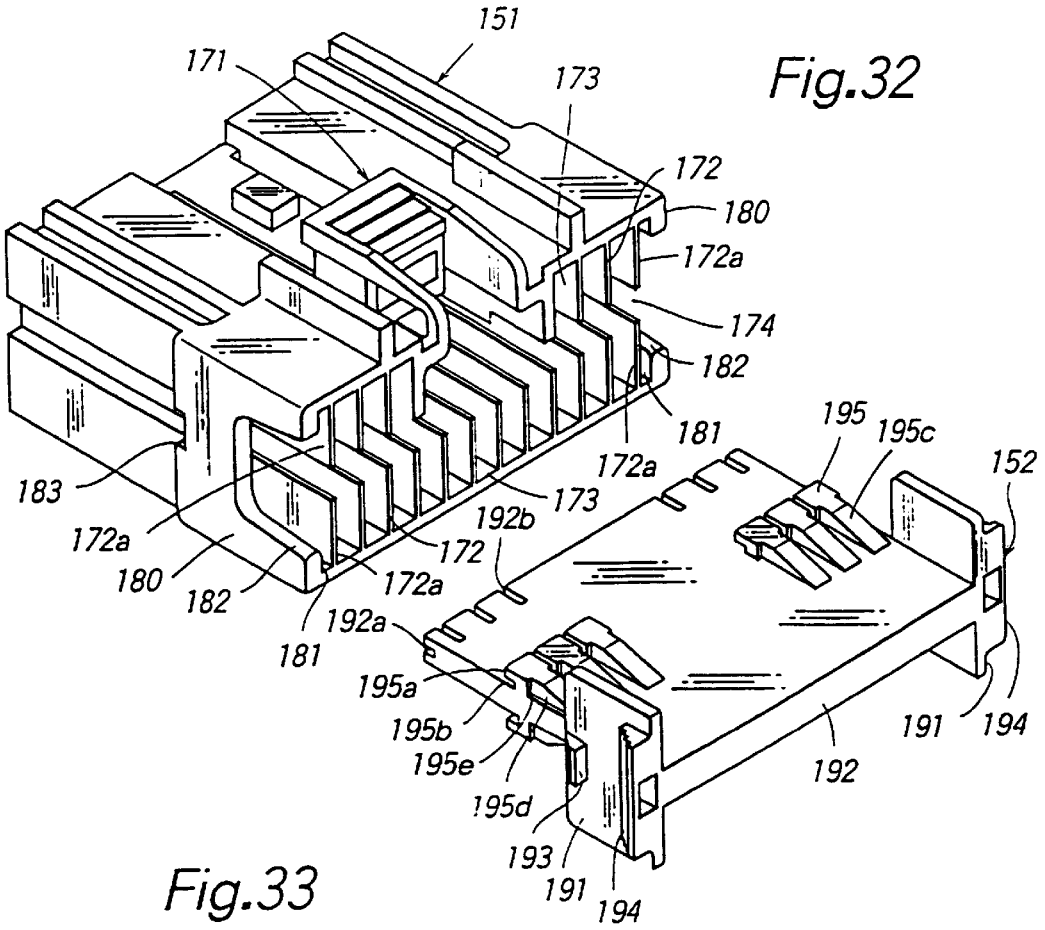
Fig.32
Fig.33
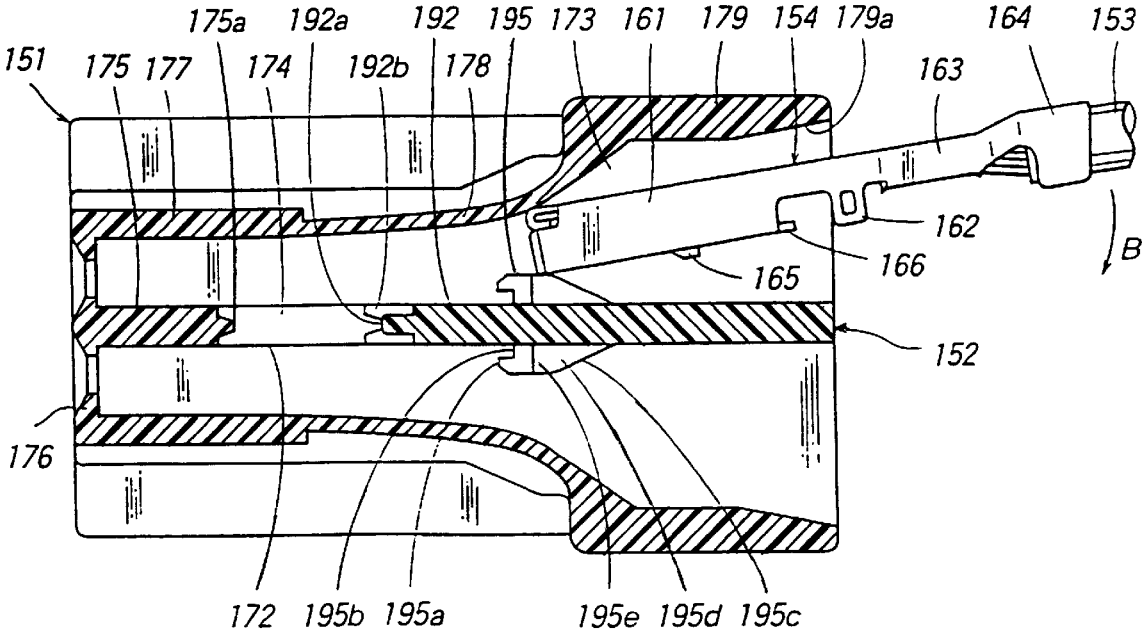

ELECTRICAL CONNECTOR

FIELD OF THE INVENTION

The present invention relates to an electric connector for use in, for instance establishing an electrical connection of an electrical wiring in automobiles, and comprising a rear retaining portion provided in a rear holder for preventing a connecting terminal inserted into the electric connector from being removed in a backward direction.

BRIEF DESCRIPTION OF THE DRAWINGS

FIG. 32 is an exploded perspective view showing mutually separated housing and rear holder in a fifth embodiment.

FIG. 33 is a vertical cross sectional view illustrating a condition in which a connecting terminal is inserted into the provisionally engaged rear holder.

TECHNICAL BACKGROUND

In a known electric connection of a kind mentioned above, in order to retain an inserted connecting terminal in position, there is usually provided a flexible retaining lance. In many cases, the retaining lance is provided integrally with the connector, but in some cases, the retaining lance is provided in a rear holder which is formed as a separate body.

Figure 1:
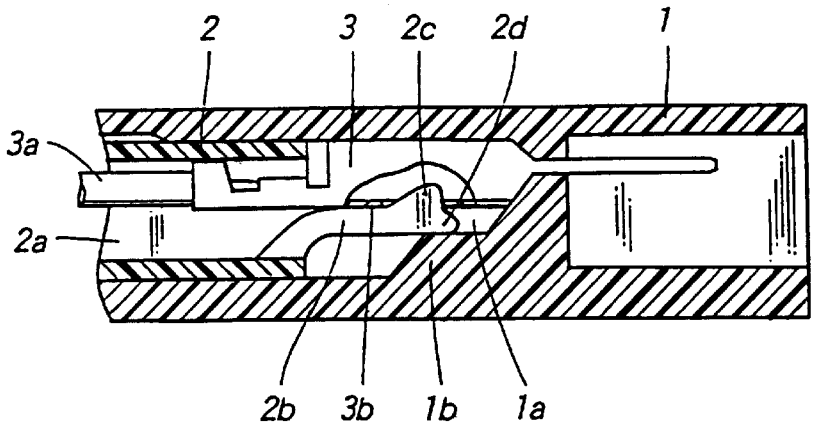
Fig.1 PRIOR ART
FIG. 1 is a side cross sectional view of a known electric connector.
Figure 2:
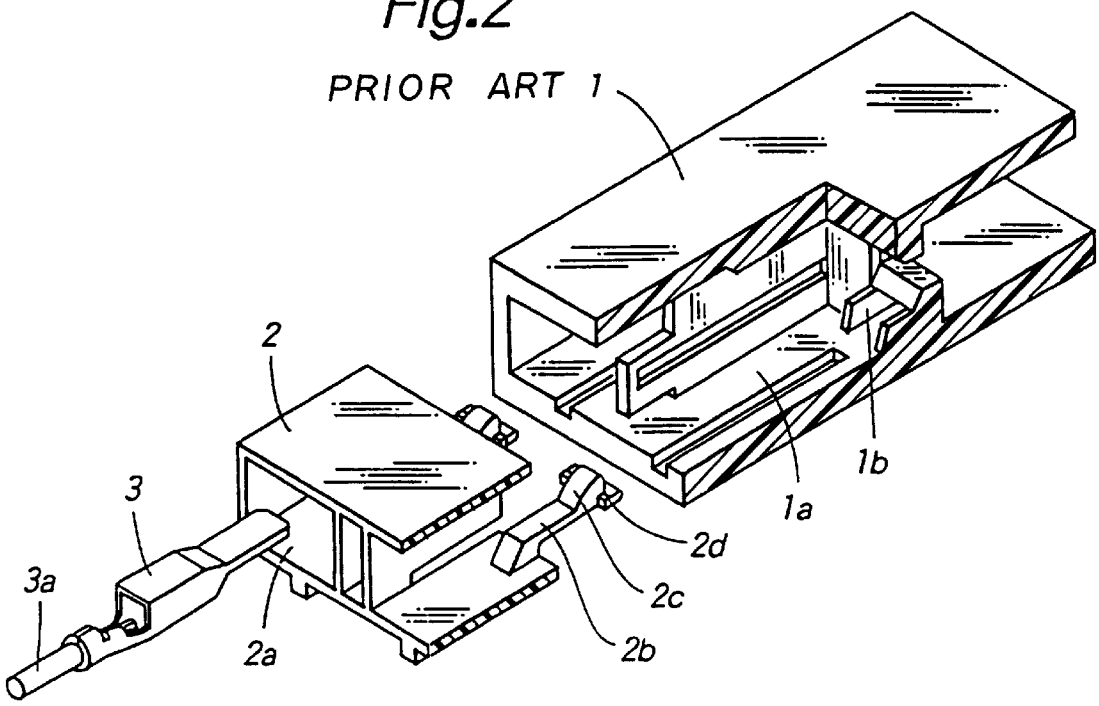
Fig.2 PRIOR ART
FIG. 2 is an exploded perspective view showing a rear holder and a housing of the known electric connector.

An example of the latter structure is shown in a drawing, in which FIG. 1 is a vertical cross sectional view and FIG. 2 is an exploded perspective view. Into a terminal receiving chamber 1*a* of a housing 1, a rear holder 2 is removably inserted in a back and forth manner. The rear holder 2 may be engaged with the housing 1 through two positions by means of an engaging means not shown. A first position is a provisionally engaged position in which the rear holder 2 is inserted into the housing 1 halfway, and a second position is a completely engaged position in which the rear holder 2 has been completely inserted into the housing 1.

In this manner, by inserting the rear holder 2 into the housing 1 through the two positions, i.e. provisionally engaged position and completely engaged position, there is produced a merit that prior to an insertion of a connecting terminal 3, the housing 1 and rear holder 2 are provisionally engaged with each other, and then in this provisionally engaged position, connecting terminals 3 having electric wires 3*a* connected thereto can be inserted into the housing 1 through the rear holder 2. In the provisionally engaged position, when the connecting terminal 3 is inserted into a terminal receiving chamber 2*a* of the rear holder, a projection 2*c* of a retaining lance 2*b* is fitted into a fitting hole 3*b* formed in a bottom portion of the connecting terminal 3. Then, when the rear holder 2 is further inserted into the housing 1 up to the completely engaged position, a tip 2*d* of the retaining lance 2*b* rides on a guide 1*b* of the housing 1, and thus a retaining force of the retaining lance 2*b* is reinforced.

In the known electric connector mentioned above, since the connecting terminal 3 is retained by a resilient force of the retaining lance 2*b*, the retaining lance 2*b* is liable to be broken by a compression force from a cooperating connecting terminal. Moreover, a mold for manufacturing the retaining lance 2*b* is expensive, and further in order to remove the connecting terminal 3, it is necessary to use a tool for disconnecting the connecting terminal from the retaining lance 2*b*. Furthermore, since there is formed a space on a lower side of a rear portion of the connecting terminal 3, the rear portion of the connecting terminal 3 might be swung within the terminal receiving chamber 2*a*. It should be noted that these problems also occur in an electric connector in which a retaining lance is formed integrally with a housing.

The present invention has for its object to provide an electric connector, in which it is no more necessary to use a retaining lance and a connecting terminal can be positively retained by means of a rear holder.

BEST MODE OF THE INVENTION

Now the present invention will be explained in detail with reference to FIGS. 3 and so on.

Figure 3:
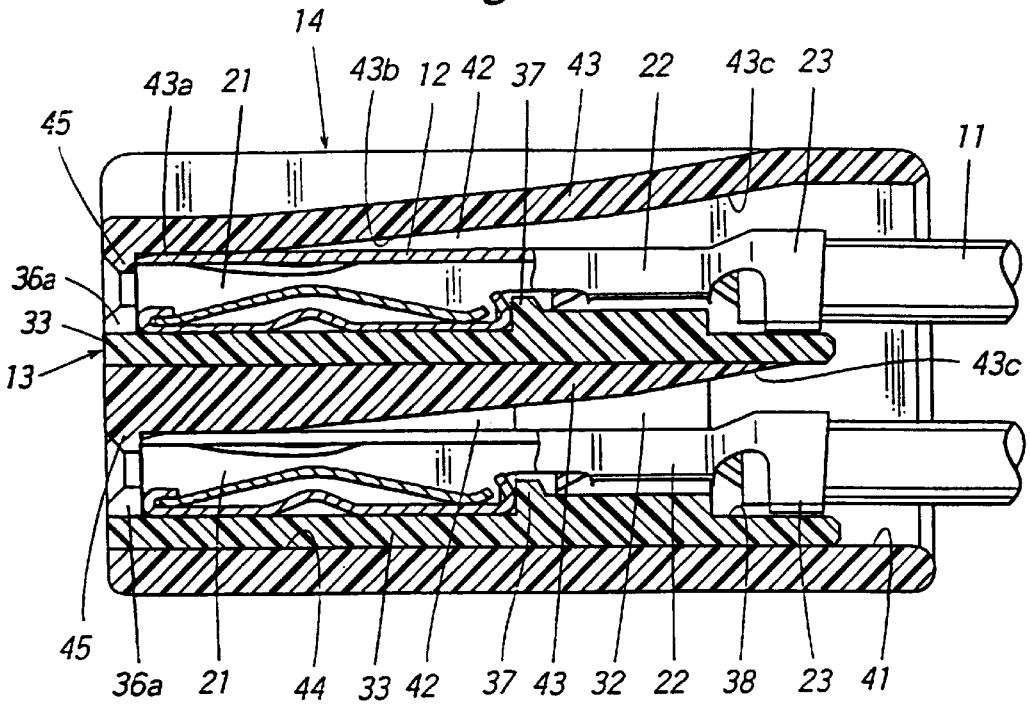
FIG. 3 is a vertical cross sectional view of a first embodiment.

FIG. 3 is a vertical cross sectional view showing a first embodiment of the invention. A connecting terminal 12 having an electric wire 11 connected thereto is held by a rear holder 13, and the rear holder is engaged with a housing 14 at a completely engaged position. The connecting terminal 12 is manufactured from an electrically conductive metal as a female type terminal, and comprises a terminal connecting portion 21 which receives a tip of a cooperating male type connecting terminal inserted into the housing, a core conductor clamping portion 22 by means of which a core conductor of the electric wire 11 is clamped, and a clad clamping portion 23 by means of which a clad of the electric wire 11 is clamped. It should be noted that if the connecting terminal 12 is of male type, an inserting portion is formed at a front end of the terminal connecting portion 21.

Figure 4:
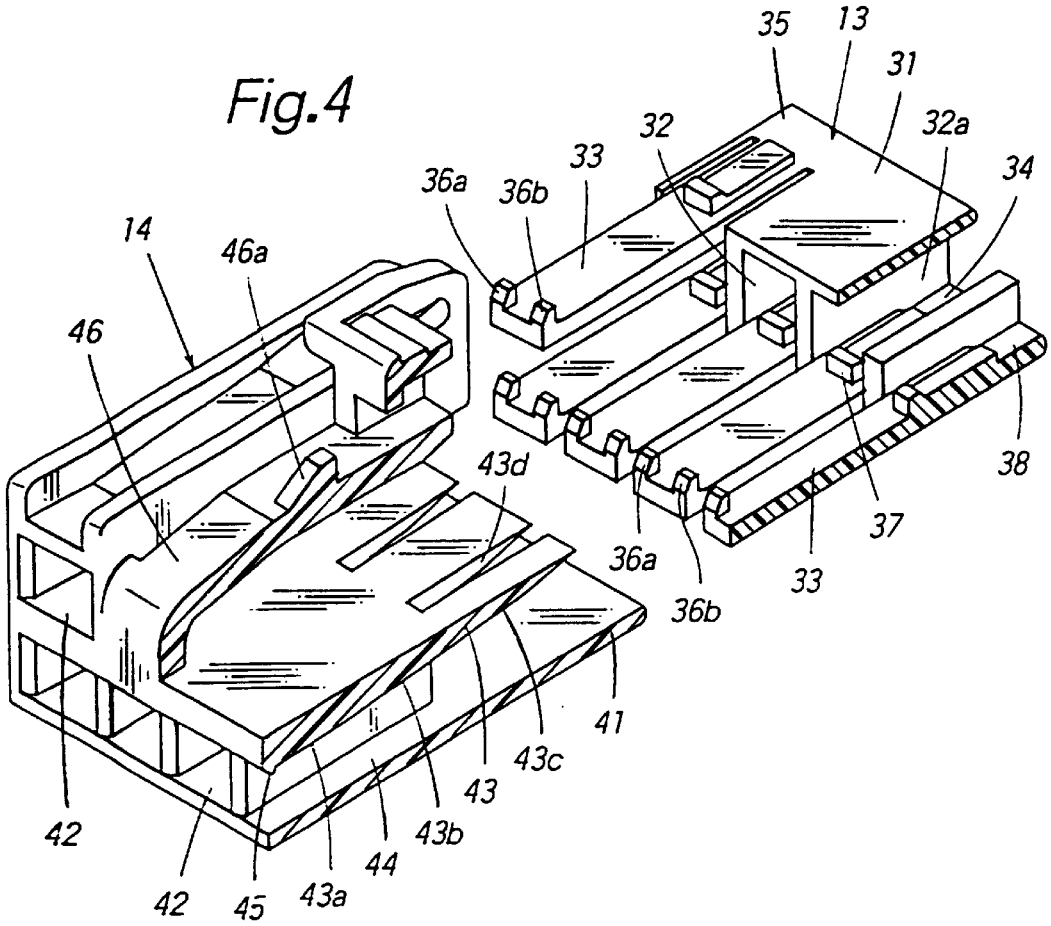
FIG. 4 is a partially cut-out perspective view illustrating a rear holder and a housing in a mutually separated condition.

The rear holder 13 and housing 14 are made of electrically insulating synthetic resin, and a main body 31 of the rear holder 13 is formed as a rectangular frame configuration as shown in FIG. 4 which is a partially cut-out perspective view, said main body being fitted in a rear portion of the housing 14. Within the main body 31 of the rear holder, there are formed a plurality of terminal receiving chambers 32 which are divided by means of partitions 32*a*, said chambers supporting rear portions of the connecting terminals 12 in such a manner that they are isolated from each other. At a front end of the main body 31 of the rear holder 13, there are provided a plurality of elongated terminal supporting portions 33 which hold the terminal connecting portions 21 of the connecting terminals 12, said terminal supporting portions being extended from a bottom wall 34 and a top wall 35 of the terminal receiving chambers 32. For instance, four terminal supporting portions are formed in a lower row and two terminal supporting portions are provided in an upper row.

At a front upper portion of the terminal supporting portion 33, there are formed front retaining portions 36*a* and 36*b* in a shape of a projection, said front retaining portions restricting a forward movement of the connecting terminal 12 by the engagement with a front edge of the terminal connecting portion 21 of the connecting terminal 12. At a rear upper portion of the terminal supporting portion 33, there is formed a rear retaining portion 37 in a shape of a projection for restricting a backward movement of the connecting terminal 12 by means of an engagement with a rear edge of the terminal connecting portion 21. In a rear portion of the bottom wall 34 of the terminal receiving chamber 32, there is formed a depressed portion 38, into which the clad clamping portion 23 of the connecting terminal 12 is inserted.

A distance between the front retaining portions 36*a*, 36*b* and the rear retaining portion 37 is determined such that the terminal connecting portion 21 can be retained therebetween without a back and forth movement. A height of the rear retaining portion 37 is determined such that the rear edge of the terminal connecting portion 21 can be sufficiently retained when the bottom wall of the terminal connecting portion 21 is brought into contact with the terminal supporting portion 33 and the clad clamping portion 23 is brought into contact with a bottom surface of the depressed portion 38.

In the housing 14, there is formed a rear holder fitting portion 41 into which the main body 31 of the rear holder is fitted in such a manner that the rear holder can move back and forth. At a front portion of the rear holder fitting portion 41, there are provided terminal receiving chambers 42 each of which accommodates a terminal holding portion 33 of the rear holder 13 and a terminal connecting portion 21 of a connecting terminal 12. A width of the terminal receiving chamber 42 is determined such that right and left movement of the terminal connecting portion 21 can be avoided. A height of the terminal receiving chamber 42 is determined such that an up and down movement of the terminal supporting portion 33 and terminal connecting portion 21 at a front portion of the terminal receiving chamber can be prevented, and the connecting terminal 12 can be easily inserted into the rear holder 13 at a rear portion of the terminal receiving chamber. To this end, in a lower surface of a front portion of a top wall 43, there is formed a parallel surface 43*a* which extends in parallel with a bottom wall 44, and in a lower surface of a rear portion of the top wall there are formed inclined surfaces 43*b*, 43*c* which are inclined in a stepwise manner such that a height becomes larger toward the rear end.

At a front end of the top wall 43, there is formed a projection 45 which is engaged with the front edge of the terminal connecting portion 21 to inhibit a forward movement of the terminal connecting portion. In a rear portion of a top wall 43 of terminal receiving chambers 42 in the lower row, i.e. a bottom wall 44 of the terminal receiving chambers 42 in the upper row, there are formed slits 43*d* into which the partitions 32*a* of the rear holder 13 are inserted. Above the top wall 43, there is provided a locking arm 46 having a locking projection 46*a* at a front end thereof, said locking projection constituting a locking mechanism when the housing 14 is coupled with a counter housing. It should be noted that the locking arm 46 is not shown in FIGS. 3 and 7–11.

Figure 5:
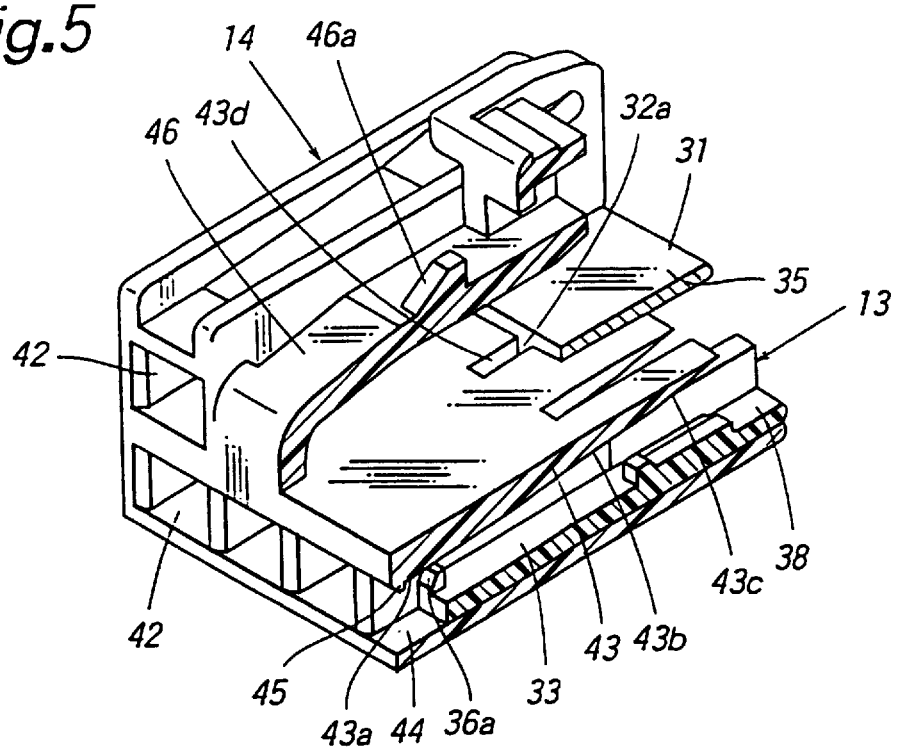
FIG. 5 is a perspective view depicting the rear holder which is provisionally engaged with the housing.

FIG. 5 is a partially cut-out perspective view of the rear holder 13 inserted into the housing 14 from its rear end. In this case, the terminal supporting portions 33 of the rear holder 13 are accommodated in respective terminal receiving chambers 42 of the housing 14 and at the same time, the main body 31 of the rear holder is fitted into the rear holder fitting portion 41 of the housing 14. Further, the partitions 32*a* of the rear holder main body 31 are inserted into respective slits 43*d* and the middle top wall 43 is inserted into the terminal receiving chambers 32. The rear holder 13 can be engaged with the housing 14 by means of a known engaging means such as a projection not shown at the provisionally engaged position as well as at the completely engaged position.

Figure 6:
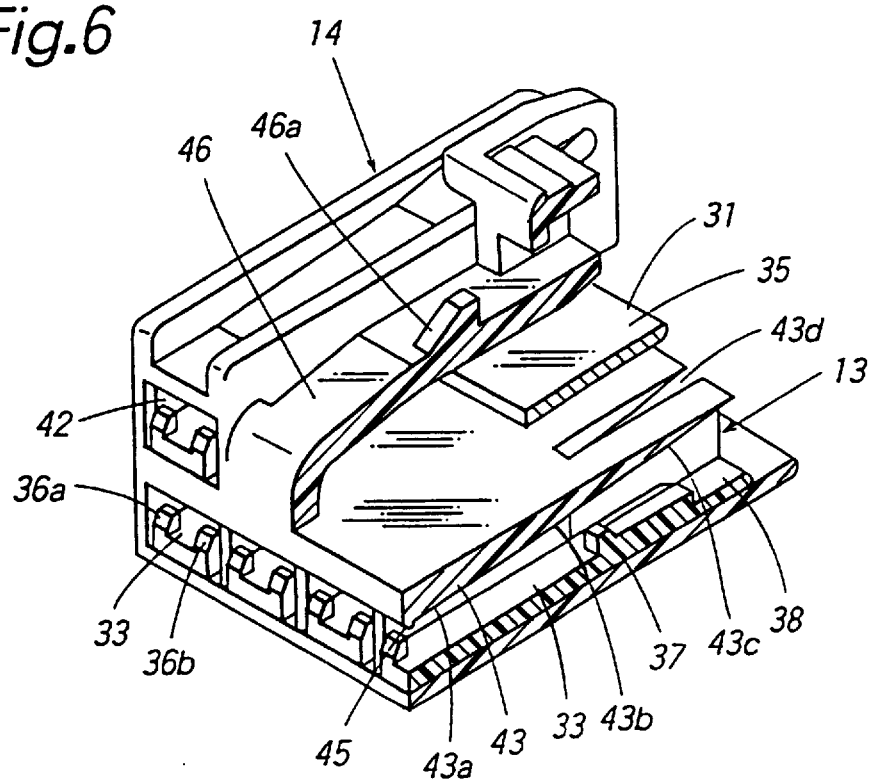
FIG. 6 is a perspective view showing the rear holder which is completely engaged with the housing.

As shown in FIG. 5, in the provisionally engaged position, the rear holder 13 is inserted into the housing 14 halfway, and the connecting terminals 12 are retained by the rear holder 13 within the terminal receiving chambers 42. As illustrated in FIG. 6, in the completely engaged position, the rear holder 13 is completely inserted into the housing 14 and the inserted connecting terminals 12 assure regular positions with respect to the housing 14.

Figure 7:
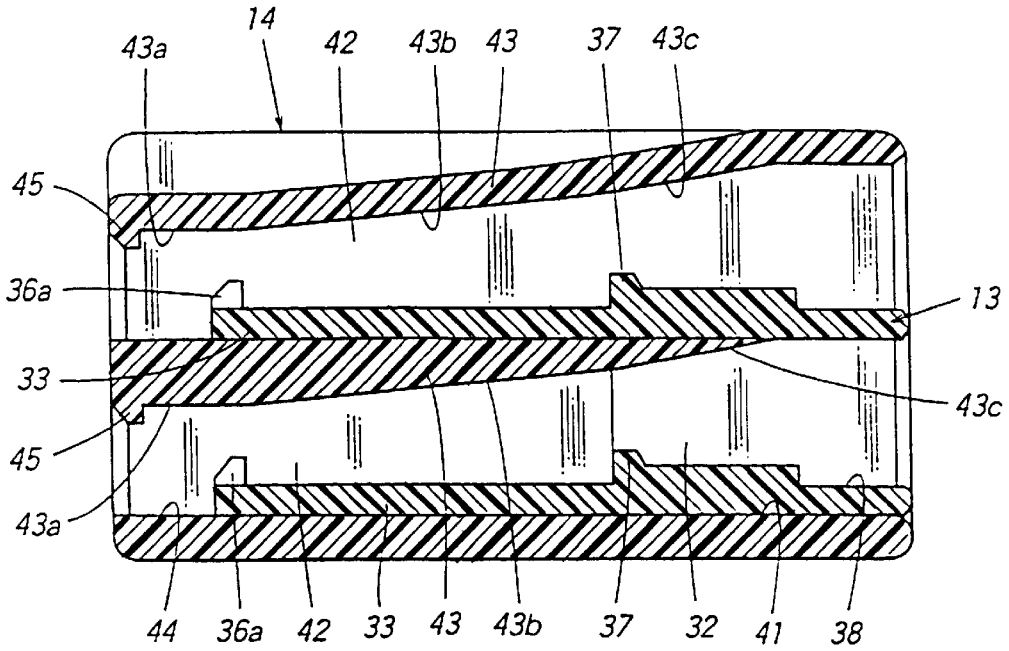
FIG. 7 is a vertical cross sectional view illustrating the rear holder provisionally engaged with the housing.
Figure 8:
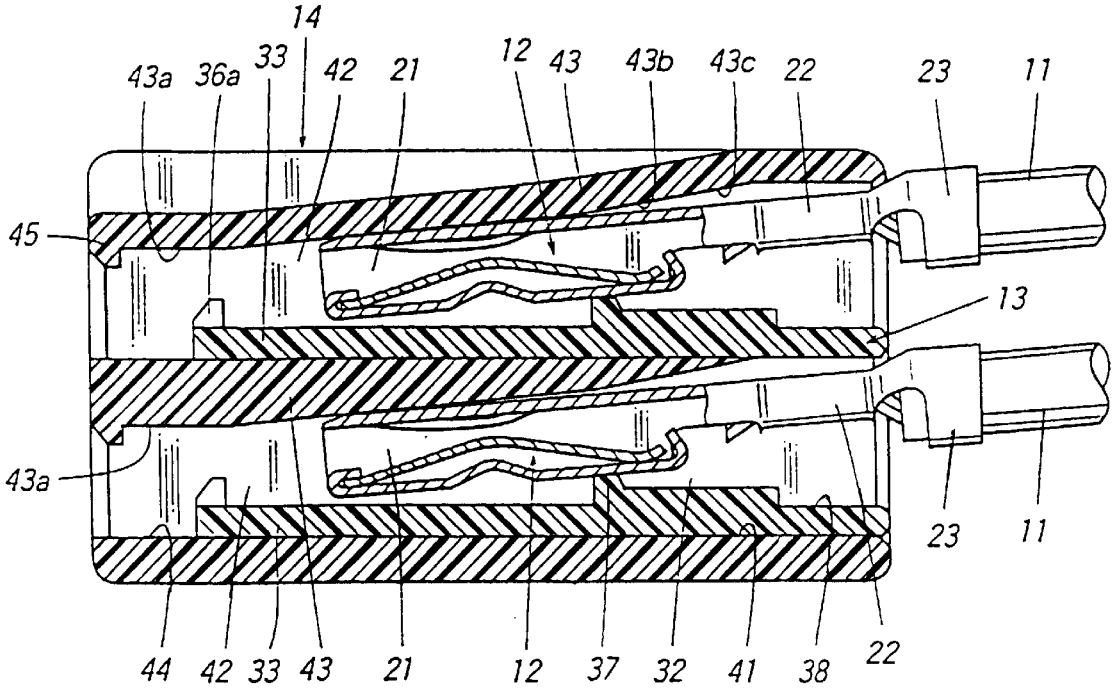
FIG. 8 is a vertical cross sectional view showing a condition in which the connecting terminal is inserted into the provisionally engaged rear holder.
Figure 9:
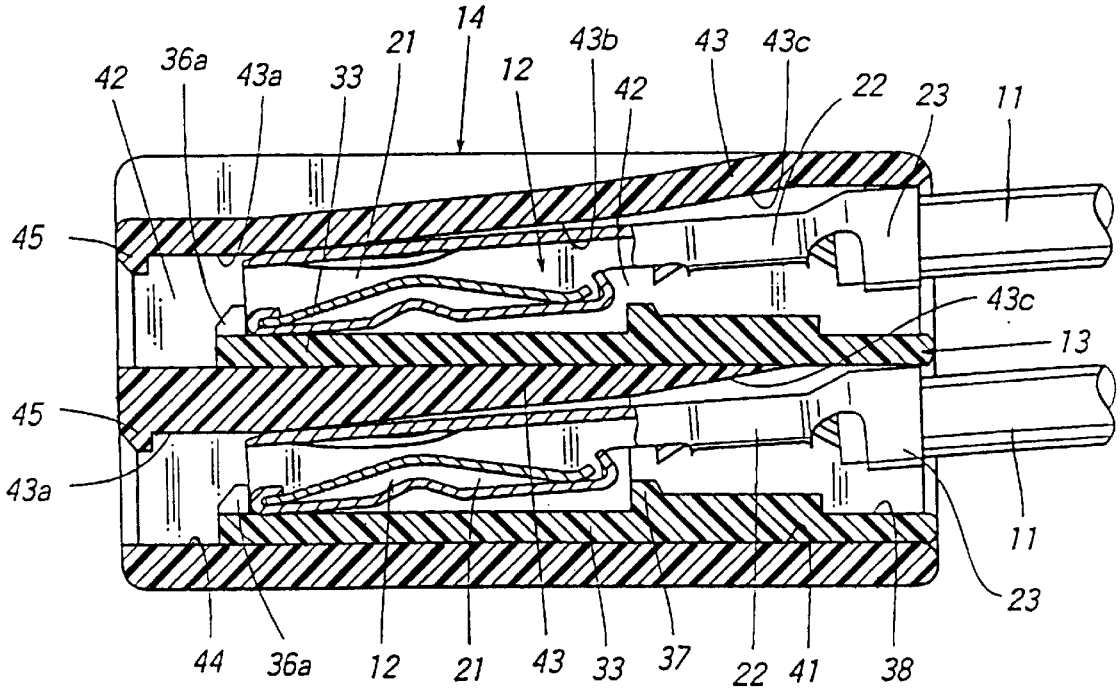
FIG. 9 is a vertical cross sectional view depicting a condition in which the connecting terminal is further inserted into the provisionally engaged rear holder.

When the connecting terminals 12 are to be accommodated in the housing 14, at first the rear holder 13 is inserted into the housing halfway as shown in FIG. 7 so as to attain the provisionally engaged position. In this position, connecting terminals 12 having electric wires 11 connected thereto are inserted one by one into the terminal receiving chambers 32 of the rear holder 13 as depicted in FIG. 8. In this manner, a front end of a terminal connecting portion 21 of a connecting terminal 12 is pushed forward between the rear retaining portion 37 and the inclined surfaces 43*b*, 43*c* along an inclined direction. When the connecting terminal 12 is further pushed forward, the front end of the terminal connecting portion 21 is brought into contact with the front retaining portions 36*a*, 36*b* of the rear holder 13 as shown in FIG. 9, and thus a forward movement of the connecting terminal 12 is inhibited. In this condition, the rear end of the terminal connecting portion 21 has passed over the rear retaining portion 37.

Figure 10:
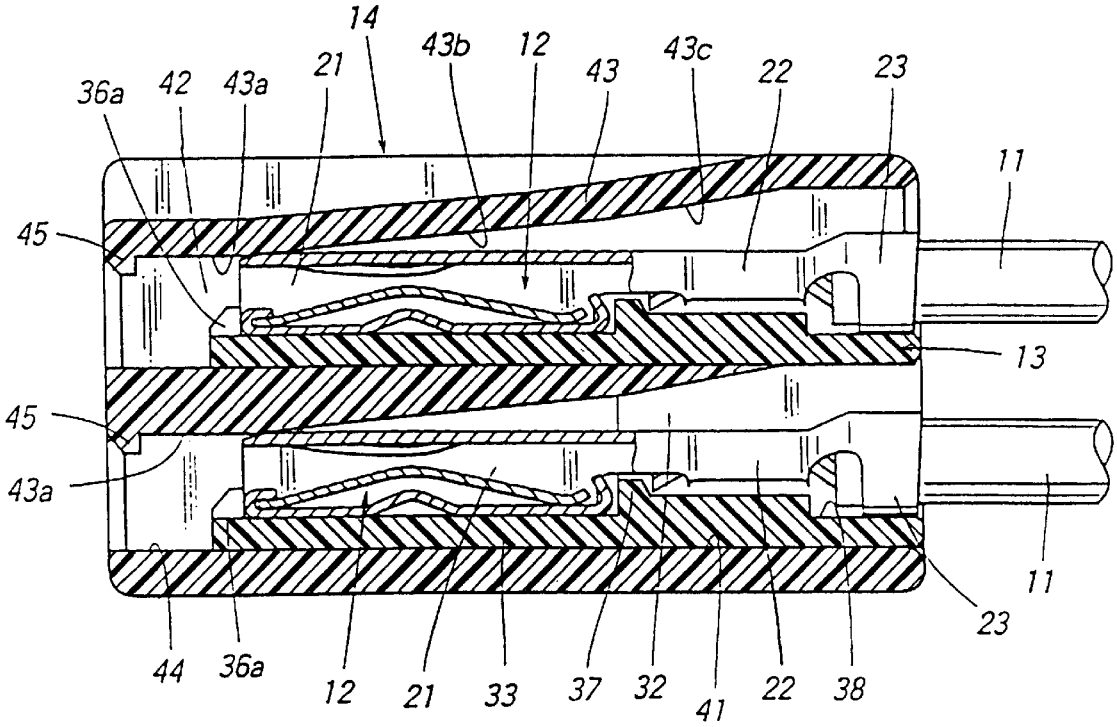
FIG. 10 is a vertical cross sectional view illustrating a condition in which the connecting terminal has been installed in the provisionally engaged rear holder.

Then, the connecting terminal 12 is pushed down as shown in FIG. 10, and the rear portion of the connecting terminal 12 is moved downward, and thus the lower surface of the terminal connecting portion 21 is intimately brought into contact with the terminal supporting portion 33, the clad clamping portion 23 is substantially brought into contact with the depressed portion 38 and the rear portion of the terminal connecting portion 21 is engaged with the rear retaining portion 37.

From this condition, the rear holder 13 is further pushed forward into the housing to attain the completely engaged position shown in FIG. 3. Then, the upper surface of the terminal connecting portion 21 is urged against the parallel surface 43*a* of the top wall 43 and the front edge of the terminal connecting portion 21 is engaged with the front retaining portions 36*a*, 36*b* and projection 45. In this condition, the connecting terminals 12 have been completely inserted into the housing 14 and are firmly retained in position.

When the connecting terminal 12 is to be removed from the housing 14, at first the retaining portion for retaining the rear holder 13 in the completely engaged position is disengaged, then the rear holder 13 is removed from the housing, and finally the connecting terminal 12 is removed from the rear holder 13.

As explained above, in the first embodiment, a size of the front portion of the terminal receiving chamber 42 is determined such that the up and down movement and the right and left movement of the terminal supporting portion 33 and terminal connection portion 21 can be restricted, and therefore in the completely engaged position, the up and down swinging movement and the right and left swinging movement of the connecting terminal 12 can be prevented. Moreover, the front and rear edges of the terminal connecting portion 21 are engaged with the front retaining portions 36*a*, 36*b* and the rear retaining portion 37 of the rear holder 13, respectively, and thus the back and forth movement of the connecting terminal 12 in the completely engaged position can be avoided.

Moreover, it is no more necessary to provide the retaining lance not only in the rear holder 13 but also in the housing 14, and therefore the configuration and construction of the rear holder 13 and housing 14 are simpler than those of the known electric connector. Therefore, the molding of these parts can be performed easily and a manufacturing cost can be decreased. Further, it is no more necessary to use a tool for disengaging the connecting terminal from the lance, since no lance is provided in the rear holder 13 and the housing 14.

Figure 11:
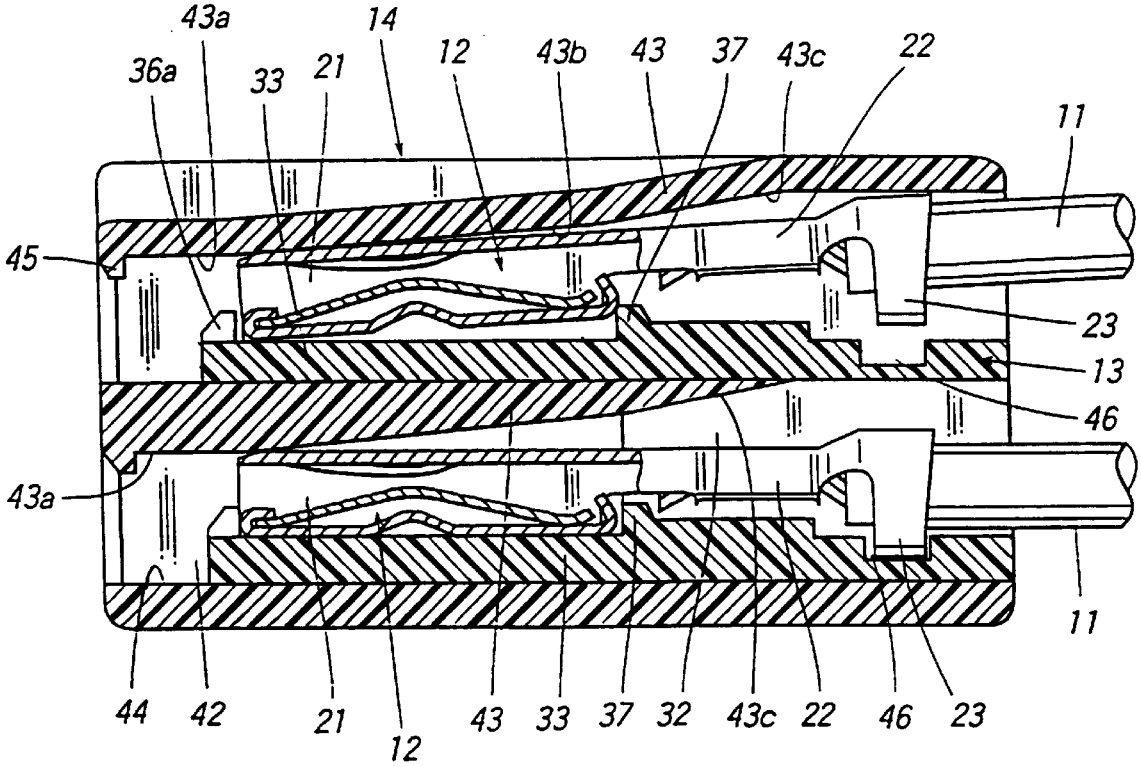
FIG. 11 is a vertical cross sectional view showing a condition in which the connecting terminal is inserted into the provisionally engaged rear holder in a modified embodiment.

FIG. 11 is a vertical cross sectional view showing a modified embodiment in the provisionally engaged position. The rear holder 13 and housing 14 have a longer size than the first embodiment, and a recess 48 is formed at the rear part of the rear holder 13 instead of the stepped portion 38. A height of the clad clamping portion 22 of the connecting terminal 12 is determined such that it is fitted into the recess 46.

In this modified embodiment, the connecting terminal 12 is retained by the front retaining portions 36*a*, 36*b*, projection 45 and rear retaining portion 37 like as the first embodiment, and further the clad clamping portion 23 is retained by front and rear walls of the recess 46. Therefore, the removal of the connecting terminal 12 in the backward and forward directions can be much more positively prevented than the first embodiment. The other advantages of the first embodiment are also attained by the modified embodiment in a substantially same manner.

Figure 12:
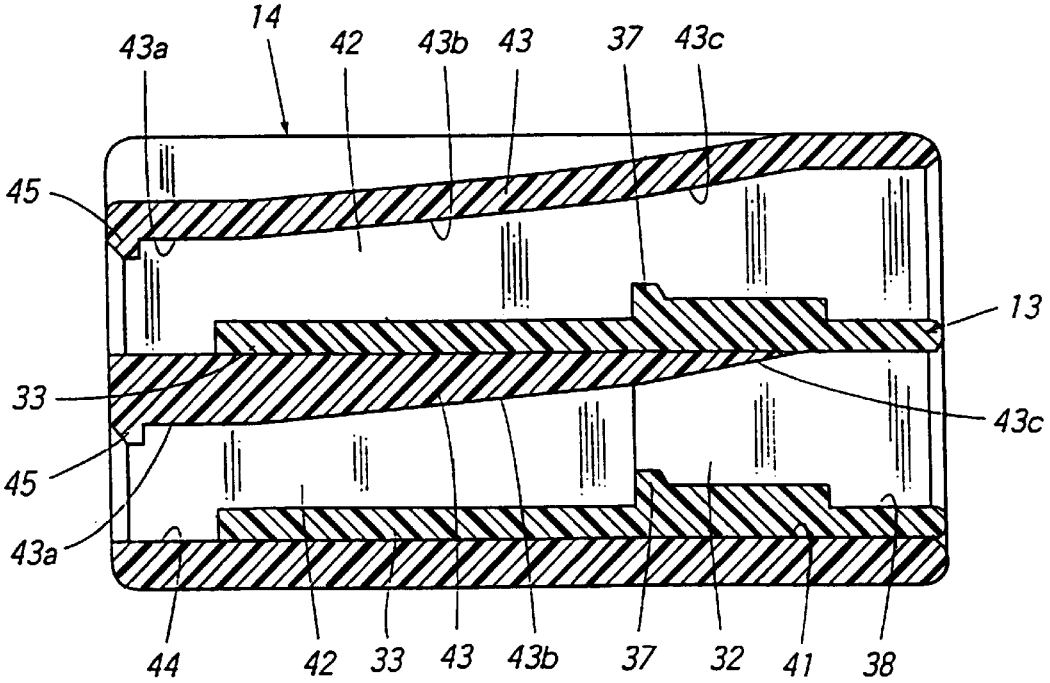
FIG. 12 is a vertical cross sectional view depicting the rear holder provisionally engaged with the housing in a modified embodiment.

FIG. 12 is a cross sectional view showing another modified embodiment. The front retaining portions 36*a*, 36*b* of the rear holder 13 are dispensed with and the front of the connecting terminal 12 is retained only by the projection 45 of the housing 14.

Figure 13:
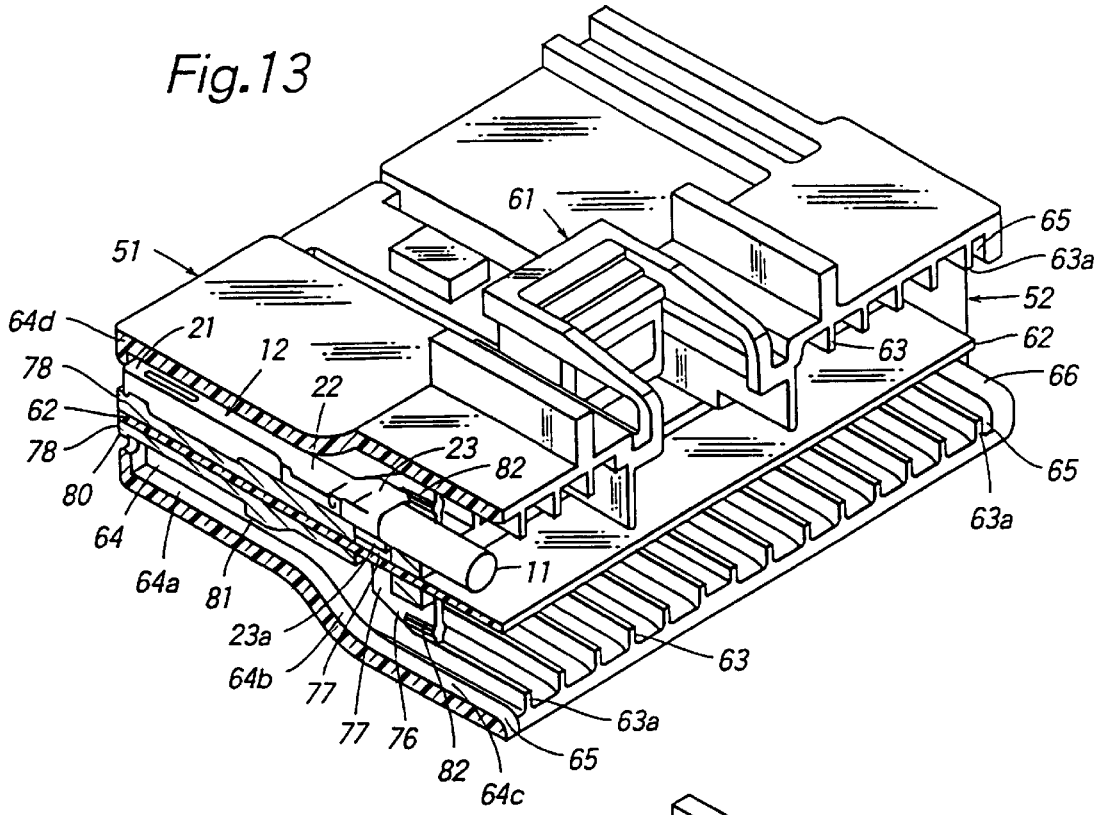
FIG. 13 is a partially cut-out perspective view showing a rear holder completely engaged with a housing in a second embodiment.
Figure 14:
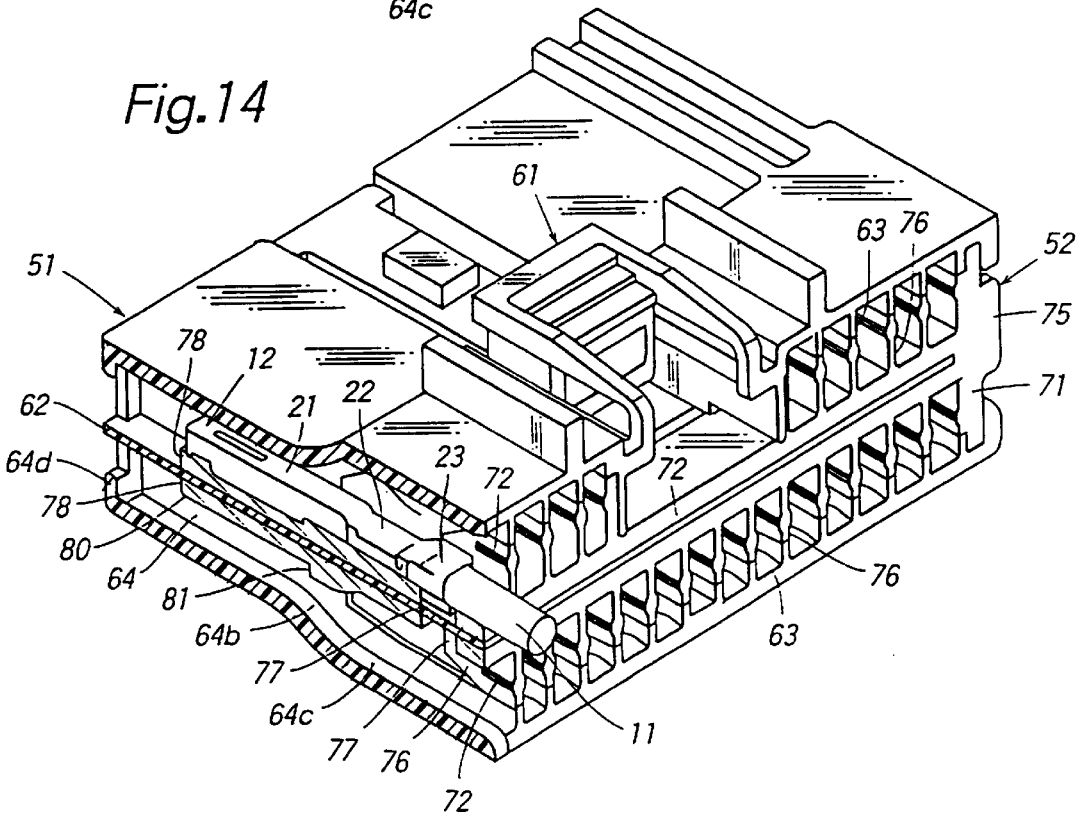
FIG. 14 is a partially cut-out perspective view illustrating the rear holder which is provisionally engaged with the housing.

FIGS. 13 and 14 are partially cut-out perspective views illustrating a second embodiment. FIG. 13 shows a condition in which a rear holder 52 is inserted into a rear portion of a housing 51 under a completely engaged condition, and connecting terminals 12 with electric wires 11 are accommodated within the housing 51 under a fully inserted condition.

FIG. 14 depicts a condition in which the rear holder 52 is provisionally engaged with the housing 51. Within the housing 51, two rows of connecting terminals 12 are provided. In each of the upper and lower rows, the connecting terminals 12 are arranged in an up and down symmetrical manner.

Figure 15:
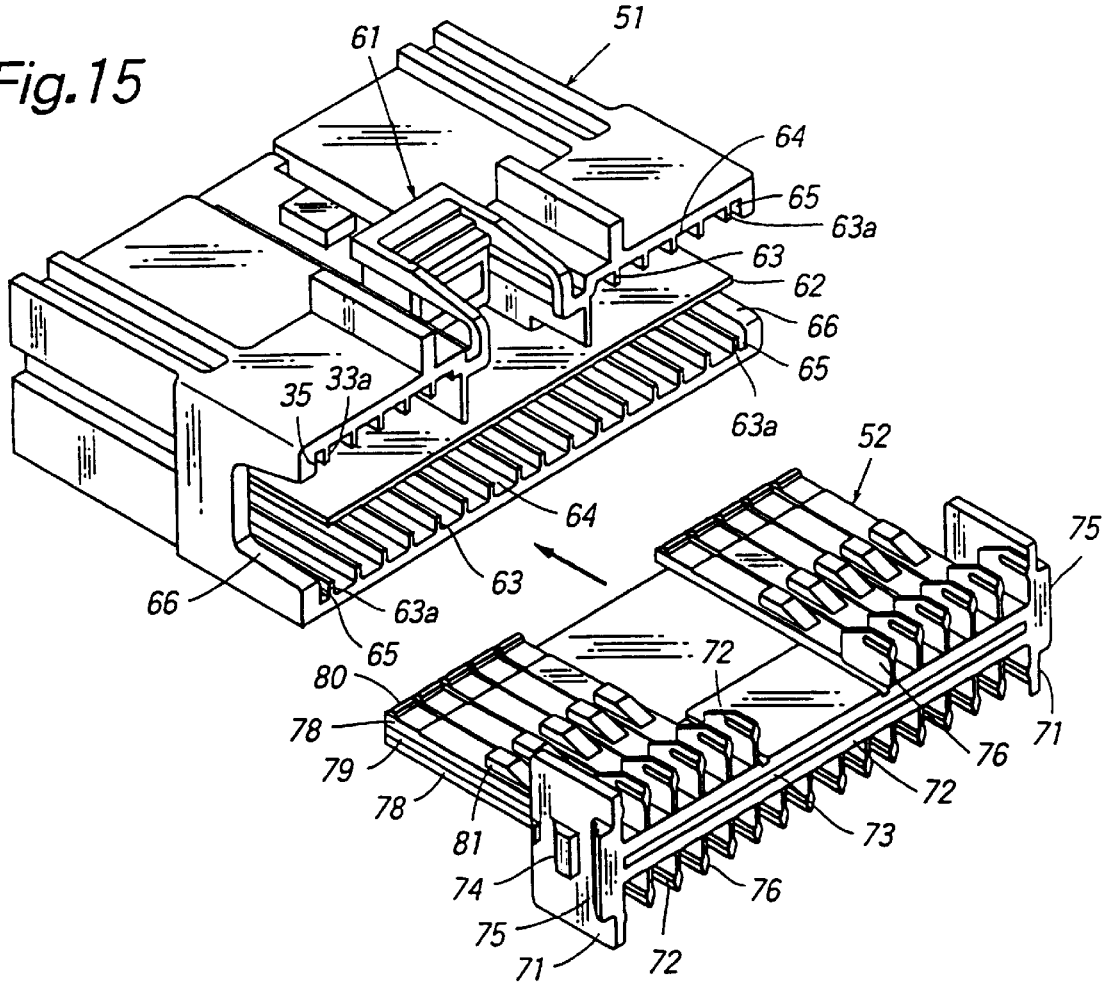
FIG. 15 is an exploded perspective view depicting the rear holder and housing separated from each other.

FIG. 15 is an exploded perspective view showing the housing 51 and rear holder 52 separated from each other. On an upper surface of the housing 51, there is provided a locking mechanism 61 which cooperates with an housing of a counter electric connector. The housing 51 is formed in a right and left symmetrical configuration and also in an up and down symmetrical configuration except for the locking mechanism 61. Within the housing 51, there are formed a plurality of terminal receiving chambers 64 which are divided vertically by a partition 62 and partition strips 63. A distance between adjacent partition strips 63 is determined such that a right and left movement of the terminal connecting portion 21 of the connecting terminal 12 can be prevented. A distance between the partition 62 of the terminal receiving chamber 64 and a front opposing wall 64*a* opposing to the partition 62 is determined such that an up and down movement of the terminal connecting portion 21 can be prevented.

A distance between the partition 62 and middle and rear opposing walls 64*b* and 64*c* is increased toward the rear end so that the connecting terminal 12 can be easily inserted into the terminal receiving chamber 64. The middle opposing wall 64*b* is inclined in such a manner that the inclined terminal connecting portion 21 of the connecting terminal 12 is brought into contact with the middle opposing wall, and the rear opposing wall 64*c* extends horizontally or is slightly inclined in such a manner that the clad clamping portion 23 is brought into contact with the rear opposing wall upon insertion of the connecting terminal 12. At a front edge of the housing 51 there is formed a front limiting portion 64*d* for limiting the forward movement of the rear holder 52 and connecting terminal 12. There is formed a space 65 between the side wall of the rear portion of housing 51 and the outermost partition strip 63*a*, said space passing the outside of the side edge of partition 62. Further, In the side wall there is formed a guide window 66.

The rear holder 52 comprises side plates 71 which are inserted into the spaces 65 of the housing 51 and a connecting plate 72 which connects said side plates 71 with each other. In the connecting plate 72 there is formed a rear slit 73 into which the partition 62 of the housing 51 is inserted. On an outer surface of the side plate 71 of the rear holder 52, there are formed a locking projection 74 which is engaged with a corresponding locking recess formed in an inner surface of the side wall of housing 51 and a guide projection 75 which is inserted into the guide window 66.

On the connecting plate 72 there are formed partition strips 76 which separate the clad clamping portions 23 of connecting terminals 12 from each other, said partition strips 76 corresponding to the partition strips 63 of the housing 51. The connecting plate 72 further has formed therein clamping portion receiving holes 77 for accommodating the projecting portions 23*a* of the clad clamping portions 23. At the front portion of the connecting plate 72 there are integrally formed terminal supporting plates 78, which are extended into the terminal receiving chambers 64 in such a manner that the terminal supporting plates are brought into contact with the partition strips 63 of the housing 51. Between the upper and lower terminal supporting plates 78 there is formed a front slit 79 in such a manner that the partition 62 of the housing 51 is passed through the front slit and is fitted into the rear slit 73.

Figure 16:
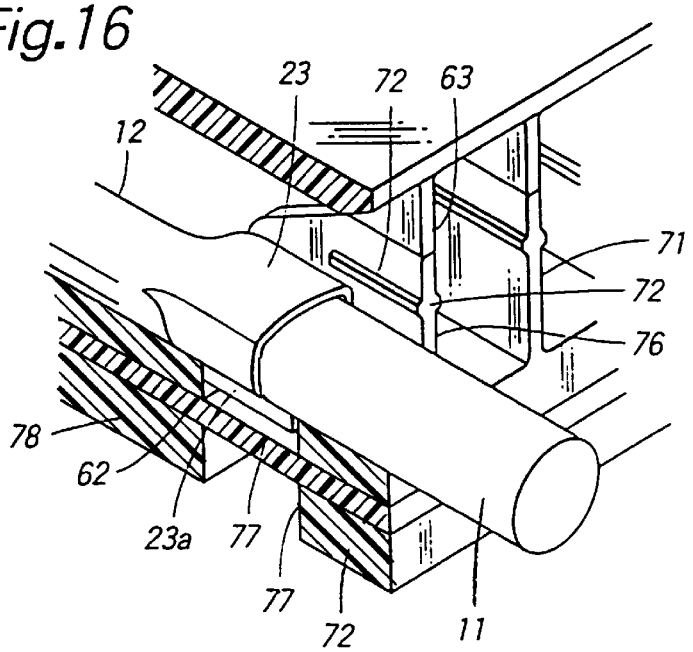
FIG. 16 is a partially enlarged perspective view showing a condition in which the connecting terminal has been installed.

The terminal supporting plate 78 comprises a front retaining portion 80 which is engaged with the front edge of the terminal connecting portion 21 of connecting terminal 12 and a rear retaining portion 81 which is engaged with the rear edge of the terminal connecting portion 21 of connecting terminal 12 which is in the horizontal position. As illustrated in the partially enlarged perspective view of FIG. 16, clamping portion retaining projections 82 are formed on the partition strips 76 in such a manner that when the connecting terminal 12 is moved from the inclined position toward the horizontal position, the clad clamping portion 23 of connecting terminal 12 passes over the clamping portion retaining projection 82 and the clad clamping portion is retained from both sides thereof by the partition strips.

The housing 51 and rear holder 52 constructed as stated above are engaged with each other into the completely engaged position shown in FIG. 13 by fully inserting the rear holder 52 into the housing 51 through the provisionally engaged position shown in FIG. 14 in which the rear holder 52 is inserted into the housing 51 halfway. In the provisionally engaged position, the partition 62 of the housing 51 is inserted into the front slit 79 of the rear holder 52 and is fitted into the rear slit 73. At the same time, the side plates 71 of the rear holder 52 are inserted into the slits 65 of the housing 51 and the locking projections 74 and guide projections 75 of the rear holder 52 are inserted into the guide windows 66 of the housing 51. In the completely engaged position, the guide projections 75 of the rear holder 52 are urged against the front wall of the guide windows 66 and the locking projections 74 are fitted into the locking recesses of the housing 51.

When the rear holder 52 is in the provisionally engaged position, a connecting terminal 12 is inserted into a terminal receiving chamber 64 in an inclined fashion, while the lower surface of the terminal connection portion 21 is brought into contact with the inclined middle opposing wall 64*b* of the housing 51, and then the front end of the terminal connection portion 21 is urged against a front retaining portion 80 so as to stop the forward movement of the connecting terminal 12. From this condition, the connecting terminal 12 is pushed toward the connecting plate 72 into the horizontal position. During this movement, the clad clamping portion 23 passes over the clamping portion retaining projection 82, the projection 23*a* of the clad clamping portion 23 is inserted into the clamping portion receiving hole 77, and at the same time the rear edge of the terminal connecting portion 21 of connecting terminal 12 situates forward the rear retaining portion 81.

In this manner, in the provisionally engaged position of the rear holder 52, the clad clamping portion 23 of connecting terminal 12 is retained by the clamp portion retaining projections 82, so that the connecting terminal 12 is prevented from returning into the inclined position. Moreover, the front edge of the terminal connecting portion 21 of terminal connecting portion 14 is retained by the front retaining portion 80 and the rear edge of the terminal connecting portion 21 is retained by the rear retaining portion 81, and therefore the back and forth movement of the connecting terminal 12 is prevented. Further, the right and left movement of the connecting terminal 12 is prevented by the partition strip 63 and clamping portion partition strip 76.

When the rear holder 52 is further moved forward from the position mentioned above, the completely engaged position shown in FIG. 13 is attained. The front edge of the terminal connecting portion 21 or terminal supporting plate 78 is urged against the front limiting portion 64*d*, the guide projection 75 of the rear holder 52 is urged against the front wall of the guide window 66, and the locking projection 74 of the rear holder 52 is fitted into the locking recess of the housing 51. In this manner, the electric connector is ready for use.

In the second embodiment, the connecting terminal 12 can be positively retained by the rear retaining portion 81 of the rear holder 52, and thus the connecting terminal is scarcely removed from the rear side of the electric connector. Moreover, a swinging movement of the terminal connecting portion 21 of connecting terminal 12 can be prevented by the front opposing wall 64*a*, terminal supporting plate 78 and both side partitions 63. A swinging movement of the clad clamping portion 23 can be avoided by the connecting plate 72, both side clamping portion partition strips 76 and both side clamping portion retaining projections 82. When the connecting terminal 12 is in a halfway inserted condition, the clamping portion retaining projection 82 could not retain the clad clamping portion 23, and thus incomplete insertion of the connection terminal 12 can be avoided.

Figure 17:
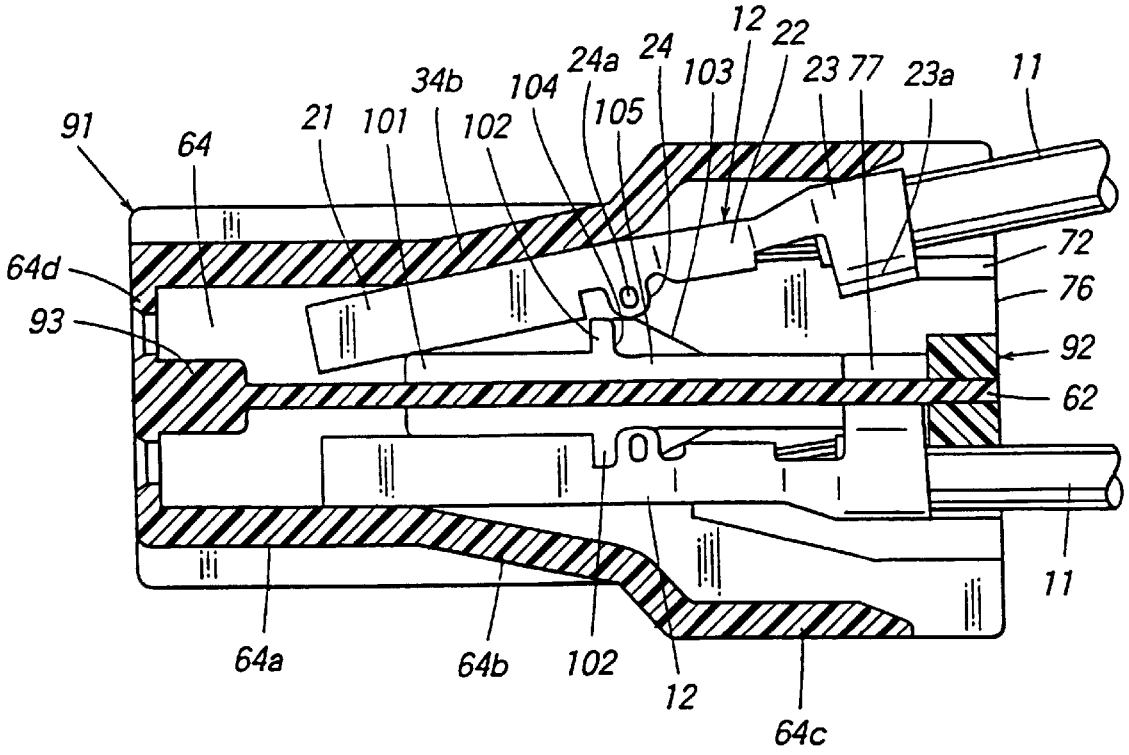
FIG. 17 is a vertical cross sectional view illustrating a condition in which a connecting terminal is inserted into a rear holder provisionally engaged with a housing in a third embodiment.

FIG. 17 is a cross sectional view showing a second embodiment, in which with a housing 91 is engaged with a rear holder 92 like as the second embodiment, and a connecting terminal 12 having an electric wire 11 connected thereto comprises terminal connecting portion 21, core conductor clamping portion 22, clad clamping portion 23 and two mutually opposing stabilizer strips 24 having holes 24*a*, said stabilizer strips being formed backside of the terminal connecting portion 21. At a front end of the partition 62 of the housing 91 there is provided a terminal supporting step 93 for supporting the terminal connecting portion 21 between the front opposing wall 64*a* and said step so that the up and down movement of the terminal connecting portion 21 is prevented.

Figure 18:
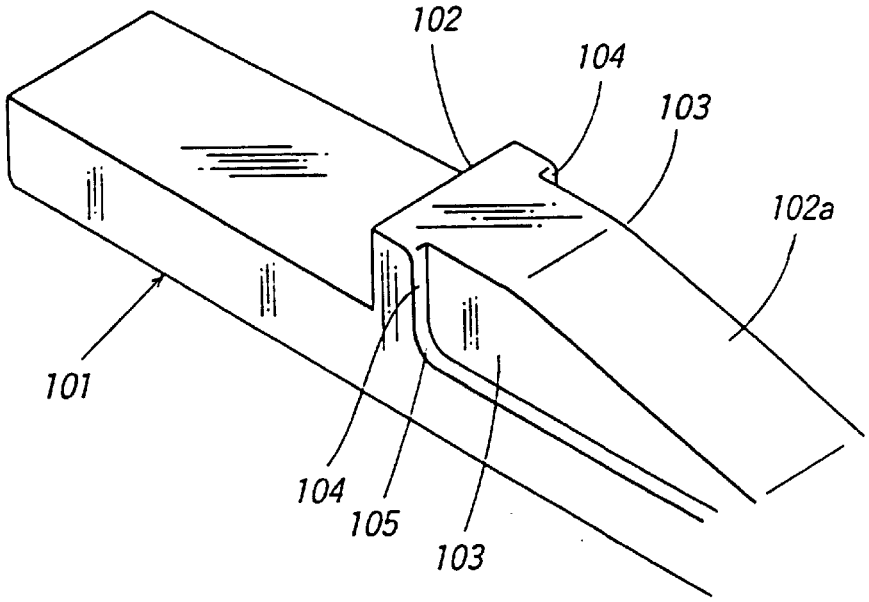
FIG. 18 is an enlarged perspective view showing a part of the rear holder.
Figure 19:
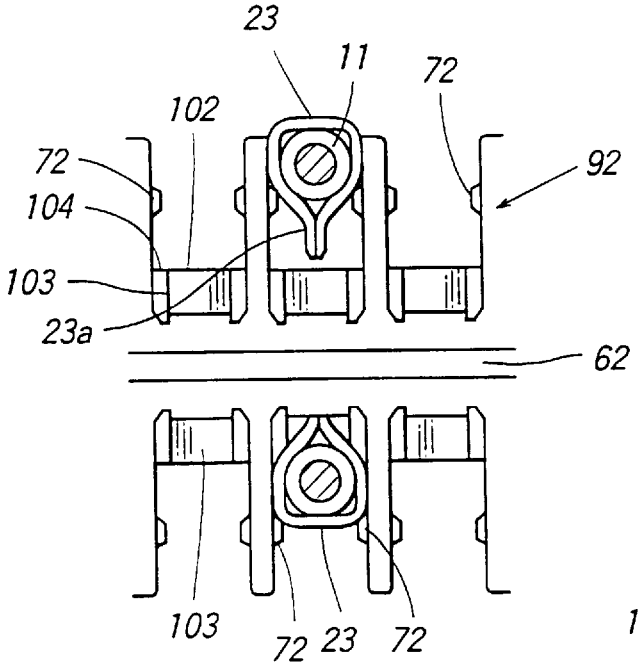
FIG. 19 is an enlarged right hand side view depicting a part of the rear holder and connecting terminal.

A terminal supporting plate 101 of the rear holder 92 does not include the front retaining portion 80 of the second embodiment, and as illustrated in a partially enlarged perspective view of FIG. 18 and a partially enlarged right hand side view of FIG. 19, on an upper surface of the terminal supporting plate there is formed a rear retaining portion 102 having an inclined surface 102*a* for retaining the terminal connecting portion 21, and in both side surfaces of the rear retaining portion 102 there are formed guide recesses 103 for guiding the stabilizer strips 24. A front wall of the guide recess 103 constitutes a stabilizer retaining portion 104 which retains the front edge of the stabilizer strip 24 when the connecting terminal 12 is in the horizontal position and the rear retaining portion 102 retains the terminal connecting portion 21. In a bottom wall of the guide recess 103 there is formed a recess 105 which receives a projection of stabilizer strip 24. The remaining construction of the present embodiment is substantially identical with that of the second embodiment.

When a connecting terminal 12 is inserted into the rear holder 92 in the provisionally engaged position, as illustrated in an upper portion of FIG. 17, the connecting terminal is inserted in an inclined fashion, while a bottom surface of the terminal connecting portion 21 is brought into contact with the middle opposing wall 64*b* of a terminal receiving chamber 64. In this case, the stabilizer strip 24 is inserted into the guide recess 103 and a front edge of stabilizer strip 24 is urged against the stabilizer retaining portion 104 to stop the insertion of the connecting terminal. Now the electric wire 11 is pushed toward the partition 62 and the connecting terminal 12 is moved into the horizontal position as shown in a lower portion of FIG. 17. Then, a front end 23*a* of the clad clamping portion 23 is fitted into the clamping portion receiving hole 77 and the projection of the stabilizer strip 24 is fitted into the recess 105.

At the same time, the rear edge of the terminal connecting portion 21 situates in front of the rear retaining portion 102 and the clad clamping portion 23 rides over the clamping portion retaining projection 82. Then, the rear holder 92 is further pushed into the housing 91 into the completely engaged position until the front edge of the terminal connecting portion 21 is urged against the terminal limiting portion 64*d* and the front portion of the terminal connecting portion 21 is clamped between the front opposing wall 64a and the terminal supporting step 93.

In the third embodiment, in the provisionally engaged position of the rear holder 92, back and forth movement of the connecting terminal in the horizontal position can be prevented by the stabilizer retaining portion 104 and rear retaining portion 102. The remaining operational function of the present embodiment is substantially same as that of the second embodiment.

Figure 20:
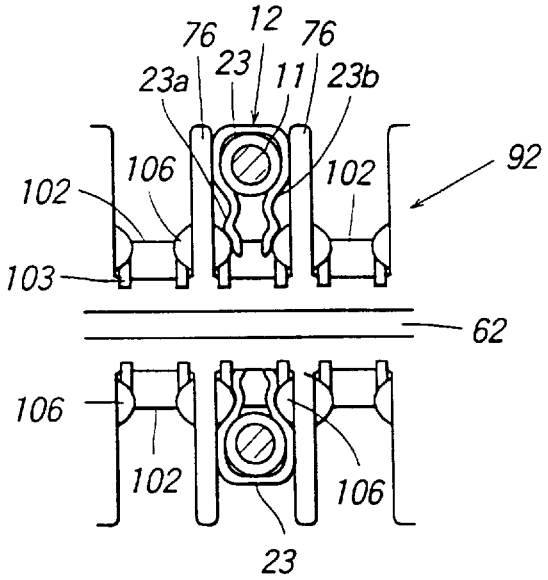
FIG. 20 is an enlarged right hand side view illustrating a part of the rear holder and connecting terminal in a modified embodiment.

The retaining structure of the clad clamping portion 23 of connecting terminal 12 and partition strip for the clad clamping portion may be realized as shown in. FIG. 20. That is to say, projections 16 provided on the clad clamping portion partition strips 76 are inserted into depressed portions 23*b* formed in the front portion 23*a* of clad clamping portion 23 by moving the connecting terminal 12 from a position shown in an upper portion of FIG. 20 into a position illustrated in a lower portion thereof.

Figure 21:
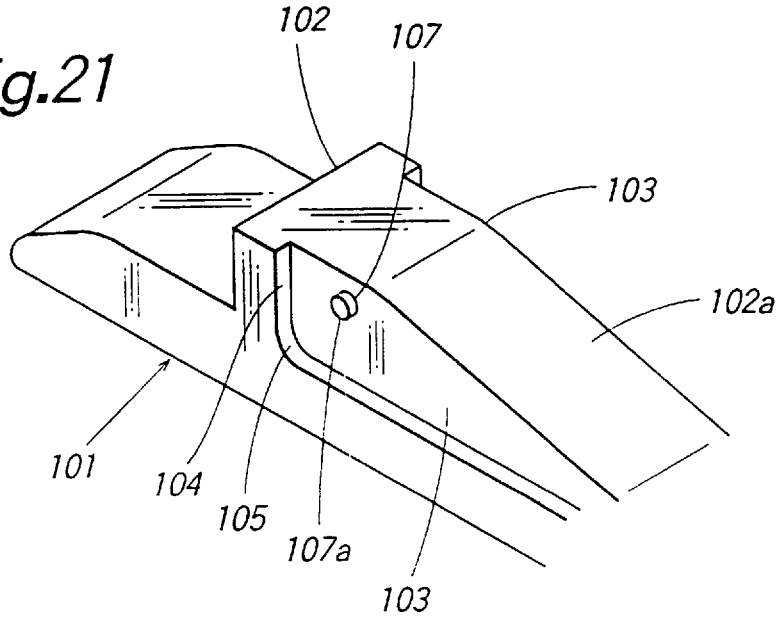
FIG. 21 is an enlarged perspective view showing a part of a rear holder of a modified embodiment.

Further as depicted in FIG. 21, by providing a projection 107 having an inclined surface 107*a* on a side wall of the guide recess 103 of the terminal supporting plate 101 such that the projection 107 is inserted into the hole 24*a* of the stabilizer strip 24, the connecting terminal 12 can be prevented from being returned into the inclined position without providing any other return preventing mechanism.

Figure 22:
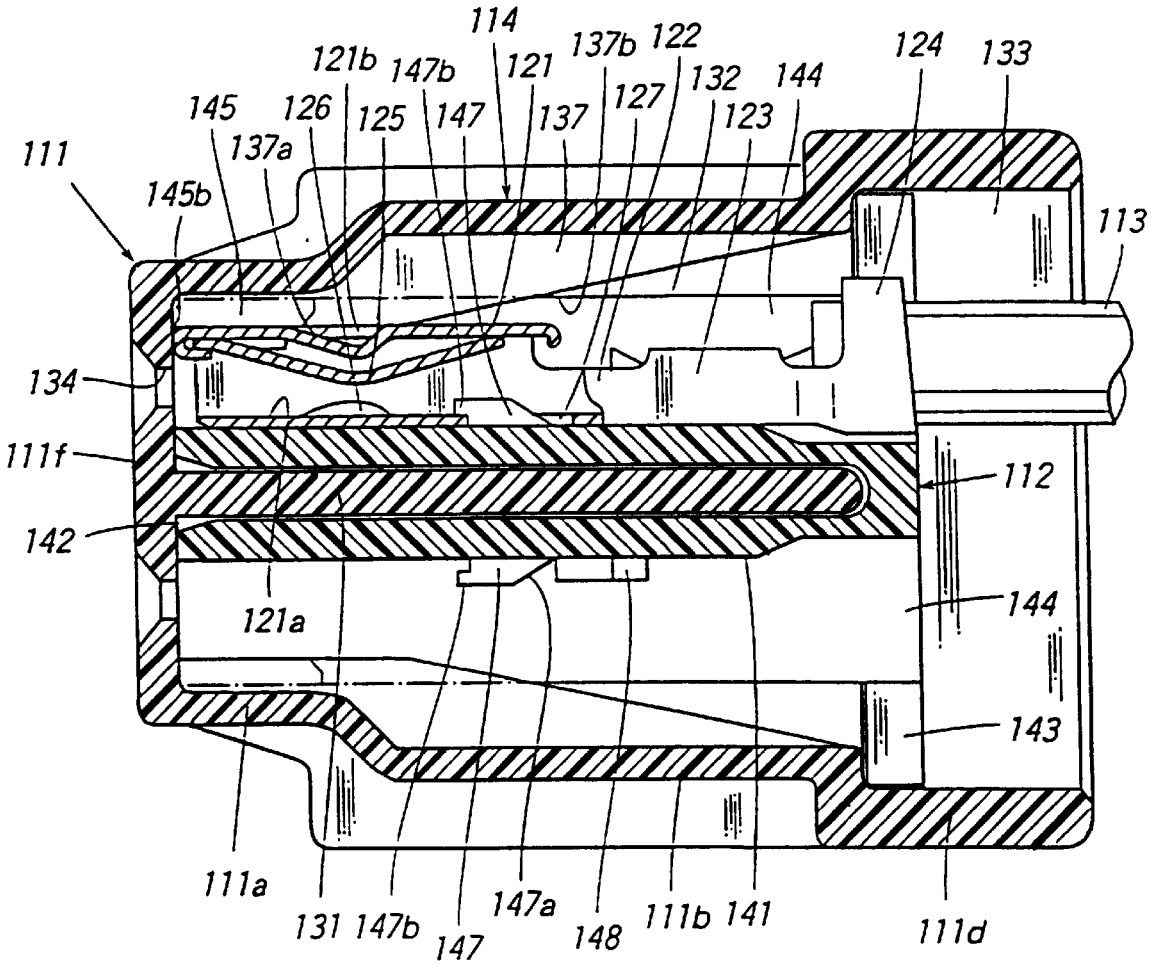
FIG. 22 is a vertical cross sectional view depicting a condition in which a rear holder is finally engaged with a housing in a fourth embodiment.
Figure 23:
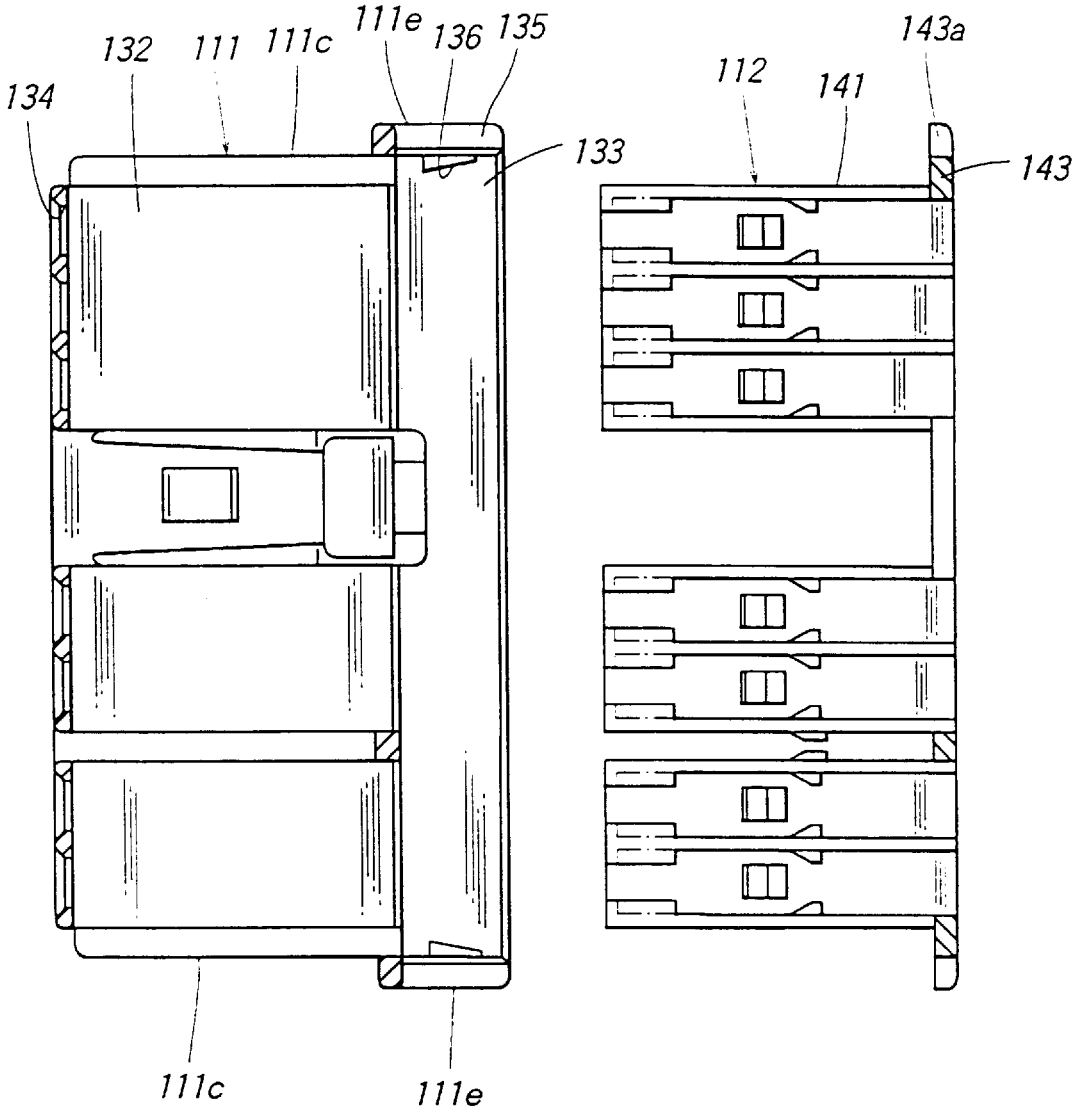
FIG. 23 is a lateral cross sectional view showing the housing and rear holder separated from each other.
Figure 24:
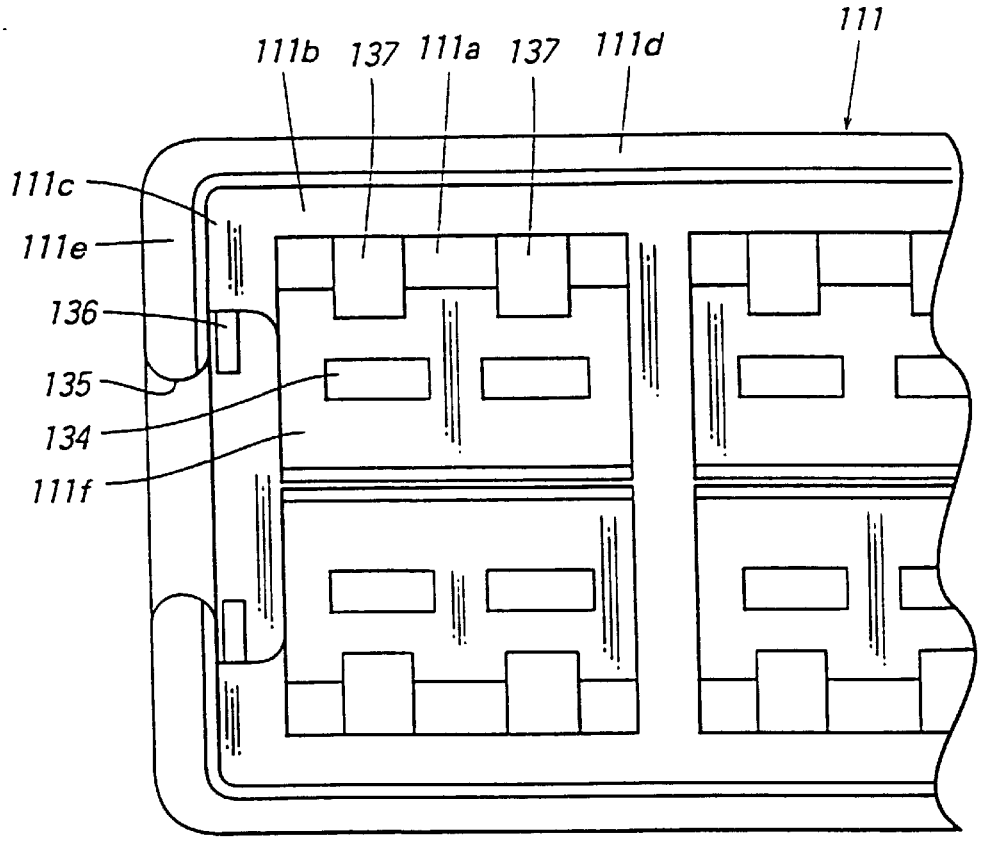
FIG. 24 is a right hand side view illustrating a part of the housing.
Figure 25:
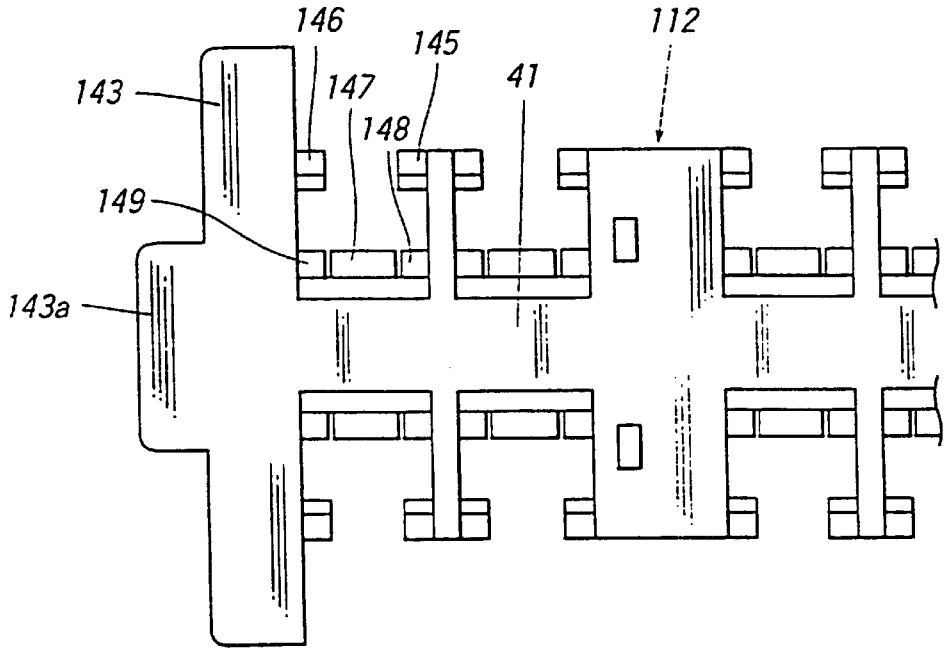
FIG. 25 is a right hand side view depicting a part of the rear holder.

FIG. 22 is a vertical cross sectional view of a fourth embodiment, in which a rear holder 112 is inserted into a housing 111 into the completely engaged position and a connecting terminal 114 having an electric wire 113 connected thereto is accommodated in a final position within the housing 111. FIG. 23 is a lateral cross sectional view depicting an exploded condition of the housing 111 and rear holder 112, FIG. 24 is a right hand side view of a part of the housing 111, and FIG. 25 is a right hand side view of a part of the rear holder 112.

Figure 26:
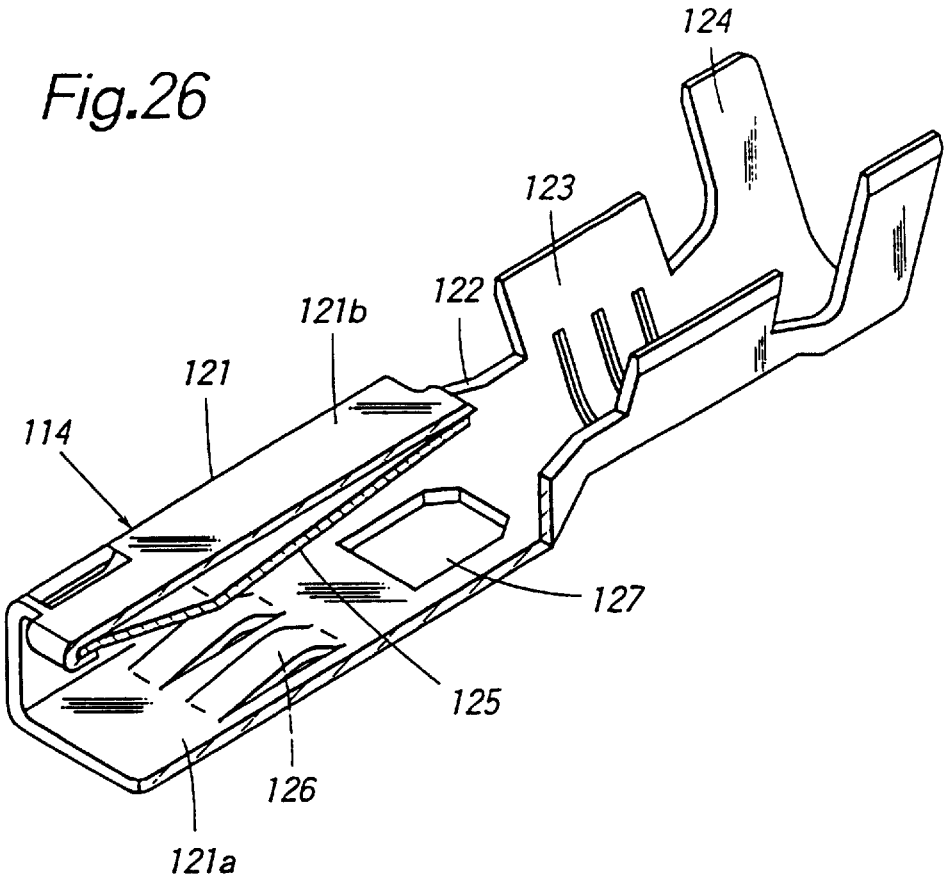
FIG. 26 is a partially cut-out perspective view showing the connecting terminal.

FIG. 26 is a partially cut-out perspective view of the connecting terminal 114, which comprises a rectangular tubular terminal connecting portion 121 for connecting a counter terminal, a connecting portion 122 whose width is decreased toward the rear side, a core conductor clamping portion 123 for clamping a core conductor of the electric wire 113, and a clad clamping portion 124 for clamping a clad of the electric wire 113, said portions being arranged in this order viewed from the front side. In a bottom plate 121*a* of the connecting terminal 114 there are formed contact portions 126 for receiving the counter terminal and a claw inserting hole 127 into which a claw portion of the rear holder 112 is inserted as will be explained later.

At a front portion of the housing 111 there are formed front portion receiving chambers 132 which are divided vertically by a partition 131 and serve to receive a front portion of the rear holder 112, and at a rear portion of the housing 111 there is provided a rear portion receiving chamber 133 for accommodating a rear portion of the rear holder 112. The front portion receiving chamber 132 is surrounded by upper and lower outer walls 111*a*, 111*b* whose distance is increased in a stepwise manner, and by right and left outer walls 111*c* having no step. The rear portion receiving chamber 133 is surrounded by upper and lower outer walls 111*d* which are separated from each other by a larger distance than the upper and lower outer walls 111*b*, and by right and left outer walls 111*e* whose distance is larger than that of the right and left outer walls 111*c*. At a front end of the housing 111 there is provided a front outer wall 111*f* and a rear end of the housing is opened. In the front outer wall 111*f* there are formed terminal insertion openings 134 through which counter terminals are inserted into the housing. In the right and left outer walls 111*e*, there are formed guide windows 135 for guiding guide projections of the rear holder 112 to be explained later and inwardly extending rear holder retaining portions 136 for retaining the rear holder 112.

A height of the upper and lower walls 111*a* is determined such that the front end portion of the rear holder 112 can be accommodated without causing a swinging movement of the rear holder, and a height of the upper and lower outer walls 111*b*, 111*d* is determined such that the connecting terminal 114 can be easily inserted into the housing 111 and rear holder 112 in an inclined fashion. On the upper and lower outer walls 11*a*, 111*b* there are formed terminal guide plates 137 for guiding respective connecting terminals 114 into the housing 111 and rear holder 112. The terminal guide plate 137 has such a thickness that it can be inserted into a space between front limiting projections formed in the rear holder 112 as will be explained later. The terminal guide plate 137 includes a horizontal surface 137*a* which is brought into contact with the terminal connecting portion 121 of the connecting terminal 114 and an inclined surface 137*b* which is brought into contact with the terminal connecting portion 121 in the inclined position.

Figure 27:
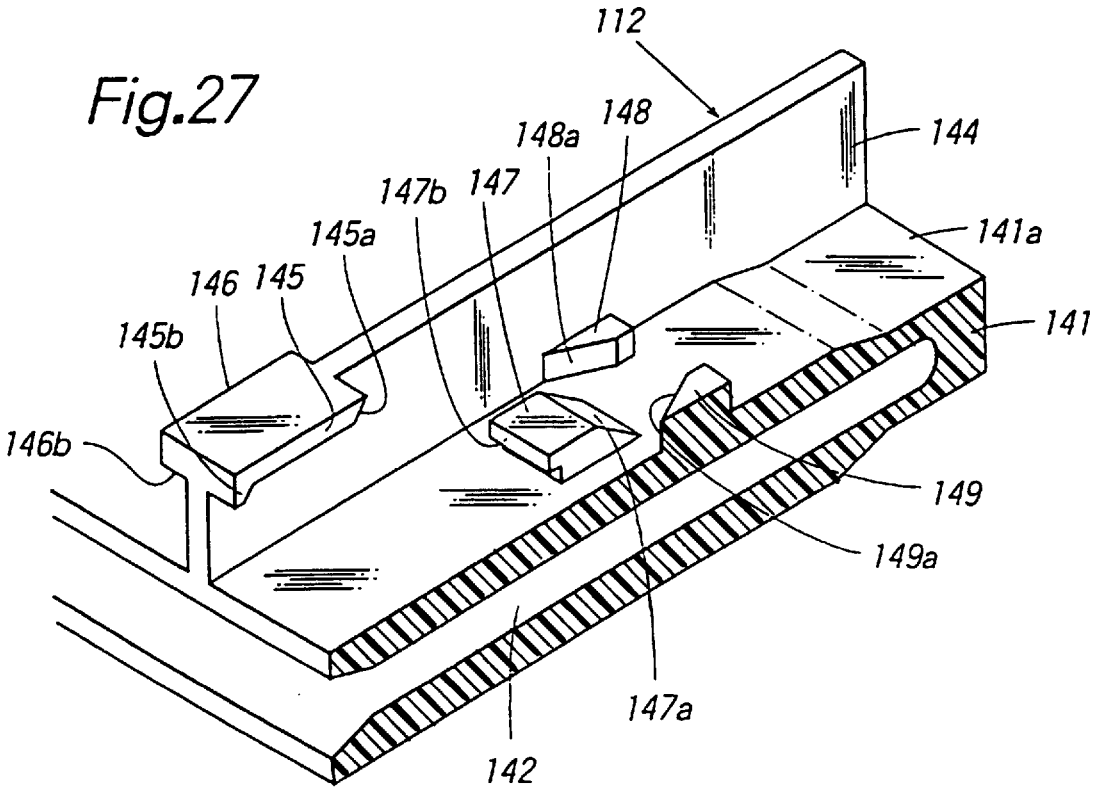
FIG. 27 is an enlarged perspective view representing a part of the rear holder.

As illustrated in FIG. 27 showing a partially enlarged perspective view, the rear holder 112 comprises a number of terminal supporting plates 141 for supporting a number of connecting terminals 114 side by side. The terminal supporting plate 141 has such a width that it can be inserted between the right and left outer walls 111*c* of the housing 111, and has a slit 142 into which a partition 131 of the housing 111 is inserted. On both sides of the rear portion of the terminal supporting plate 141 there are formed side plates 143 which moves back and forth along inner surfaces of the right and left outer walls 111*e* of the housing 111, and guide projections 143*a* are formed on the side plates 143, said guide projections being guided by the guide windows 135 of the housing.

Upper and lower surfaces of the rear portion of the terminal supporting plate 141 are formed as rear supporting portions 141*a* for supporting the clad clamping portion 124 of the connecting terminal 114, said rear supporting portions descending by one step. On the upper and lower surfaces of the terminal supporting plate 141 there are provided partition walls 144 which separate adjacent connecting terminals 114 from each other. On both sides of the front portion of the partition wall 144 there are formed front limiting projections 145, 146 which prevent the up and down movement of the front portion of the connecting terminal 114. A distance between these front limiting projections 145 and 146 is determined such that the terminal guide plate 137 of the housing 111 is inserted therebetween. In the rear edges of the front limiting projections 145, 146 there are formed inclined surfaces 145*a*, 146*a* (surface 146*a* is not shown), and at the front edges there are formed projections 145*b*, 146*b* for retaining the front edge of the connecting terminal 114.

Furthermore, in the terminal supporting plate 141 between successive partition walls 144, there is formed a rear retaining portion 147 in a shape of a projection, which is inserted into the claw insertion hole 127 of the connecting terminal 114 for preventing the backward removal of the connecting terminal 114 as well as the return of the connecting terminal into the inclined position. In a rear portion of the rear retaining portion 147 there is formed an inclined surface 147*a* which makes an easy insertion of the rear retaining portion into the claw inserting hole 127 of the connecting terminal 114. At a front portion of the rear retaining portion 147, there is formed a claw portion 147*b* which retains the upper surface of the bottom plate 121*a* of the connecting terminal 114 when the connecting terminal 114 in the horizontal position is pulled backward. At the back of the rear retaining portion 147 there are provided rear limiting projections 148, 149 which prevent the right and left movement of the connecting terminal 114 by being brought into contact with both sides of the connecting portion 122 of the connecting terminal 114. In inner surfaces of these rear limiting projections 148, 149 there are formed inclined surfaces 148*a*, 149*a* by means of which the connecting portion 122 of the connecting terminal 114 can be easily received when the connecting terminal is moved backward.

Figure 28:
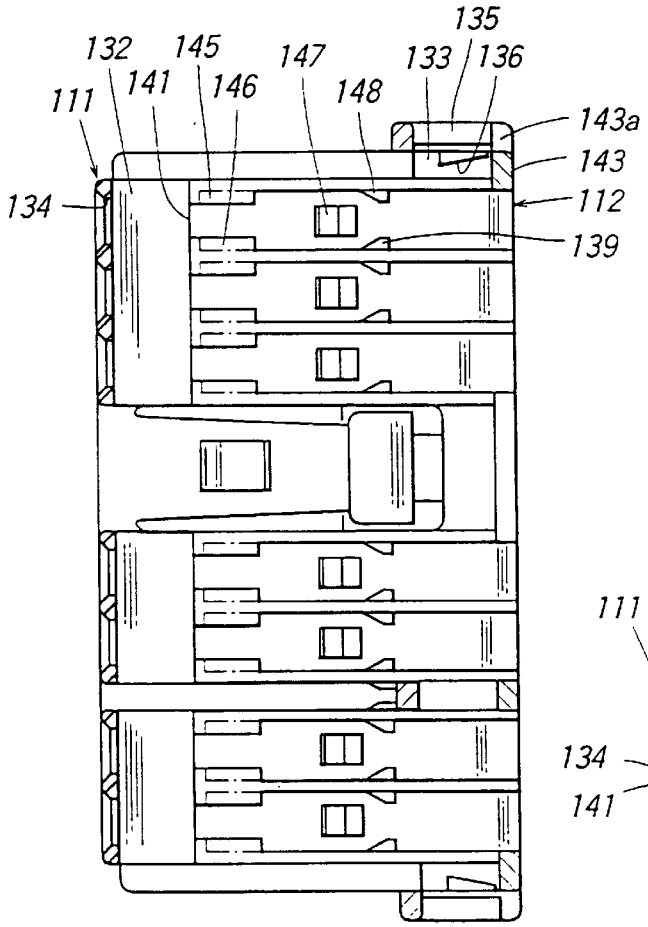
FIG. 28 is a lateral cross sectional view illustrating a condition in which the rear holder is provisionally engaged with the housing.
Figure 29:
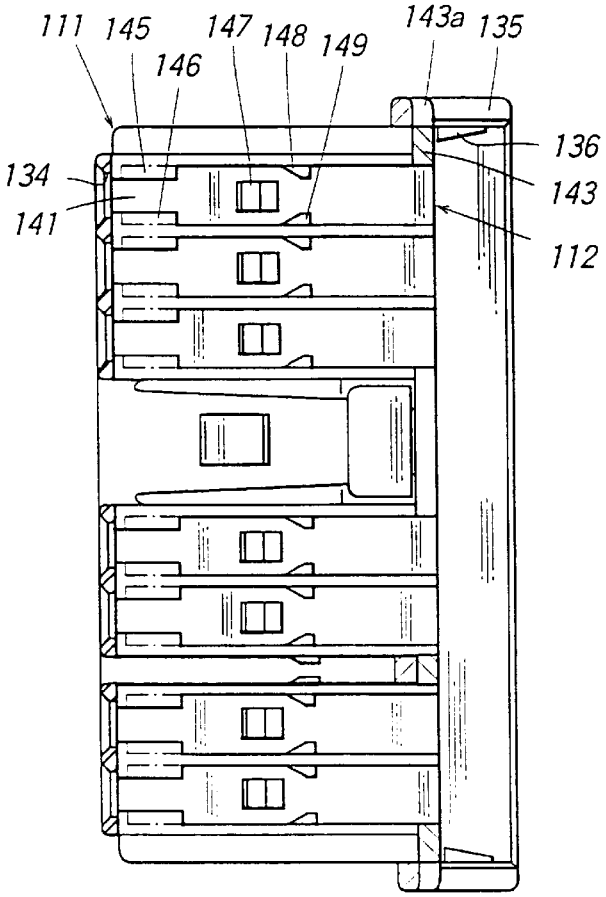
FIG. 29 is a lateral cross sectional view showing a condition in which the rear holder is completely engaged with the housing.

The housing 111 and rear holder 112 are engaged with each other in the provisionally engaged position shown in FIG. 28, in which the rear holder is inserted into the housing halfway as well as in the completely engaged position illustrated in FIG. 29, in which the rear holder has been fully inserted into the housing. In the provisionally engaged position and completely engaged position, the terminal supporting plates 141 of the rear holder 112 are inserted into the front portion receiving chamber 132 and the partition 131 of the housing 111 is inserted into the slit 142 of the rear holder 112. Further, the side plates 143 are inserted into the rear portion receiving chamber 133 and the guide projections 143*a* of the rear holder 112 are inserted into the guide windows 135 of the housing 111. In this case, the terminal guide plate 137 of the housing 111 are clamped between the front limiting projections 145, 146 of the rear holder 112. In the provisionally engaged position, the rear edge of the rear holder 112 is substantially aligned with the rear edge of the housing 111, and in the completely engaged position, the rear edge of the rear holder 112 is retained by the rear holder retaining portions 136 provided on the housing 111.

Figure 30:
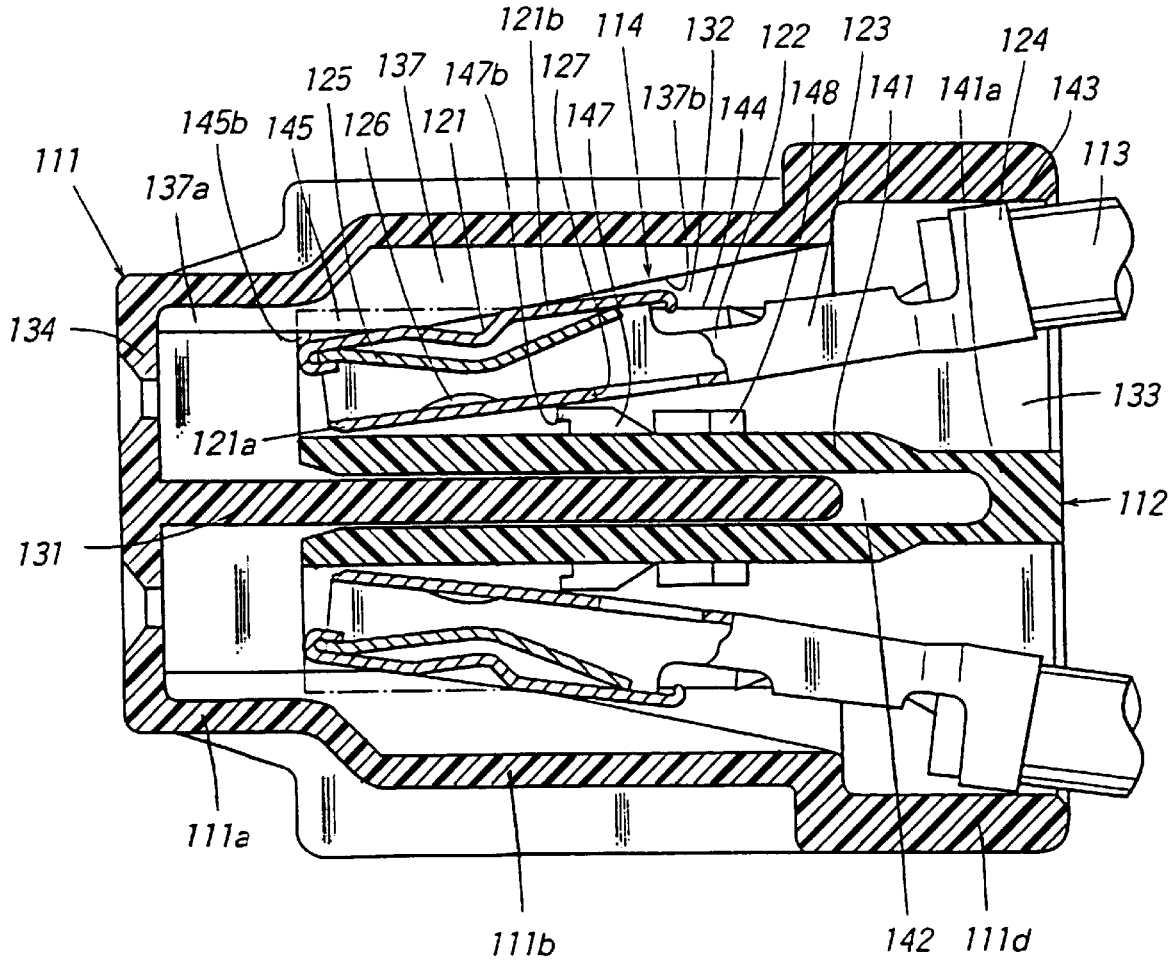
FIG. 30 is a vertical cross sectional view depicting a condition in which the connecting terminal is inserted into the provisionally engaged rear holder.

As shown in FIG. 30, when the rear holder 112 is in the provisionally engaged position, the connecting terminal 114 with the electric wire 113 is inserted into the housing 111 and rear holder 112 in an inclined fashion. When the connecting terminal 114 is inserted, the bottom plate 121*a* of the terminal connecting portion 121 is brought into contact with the upper surface of the rear retaining portion 147, and the top plate 121*b* is brought into contact with a boundary between the horizontal surface 137*a* and an inclined surface 137*b* of the terminal guide plate 137 until the front edge of the terminal connecting portion 121 comes into contact with the projections 145*b*, 146*b*.

Figure 31:
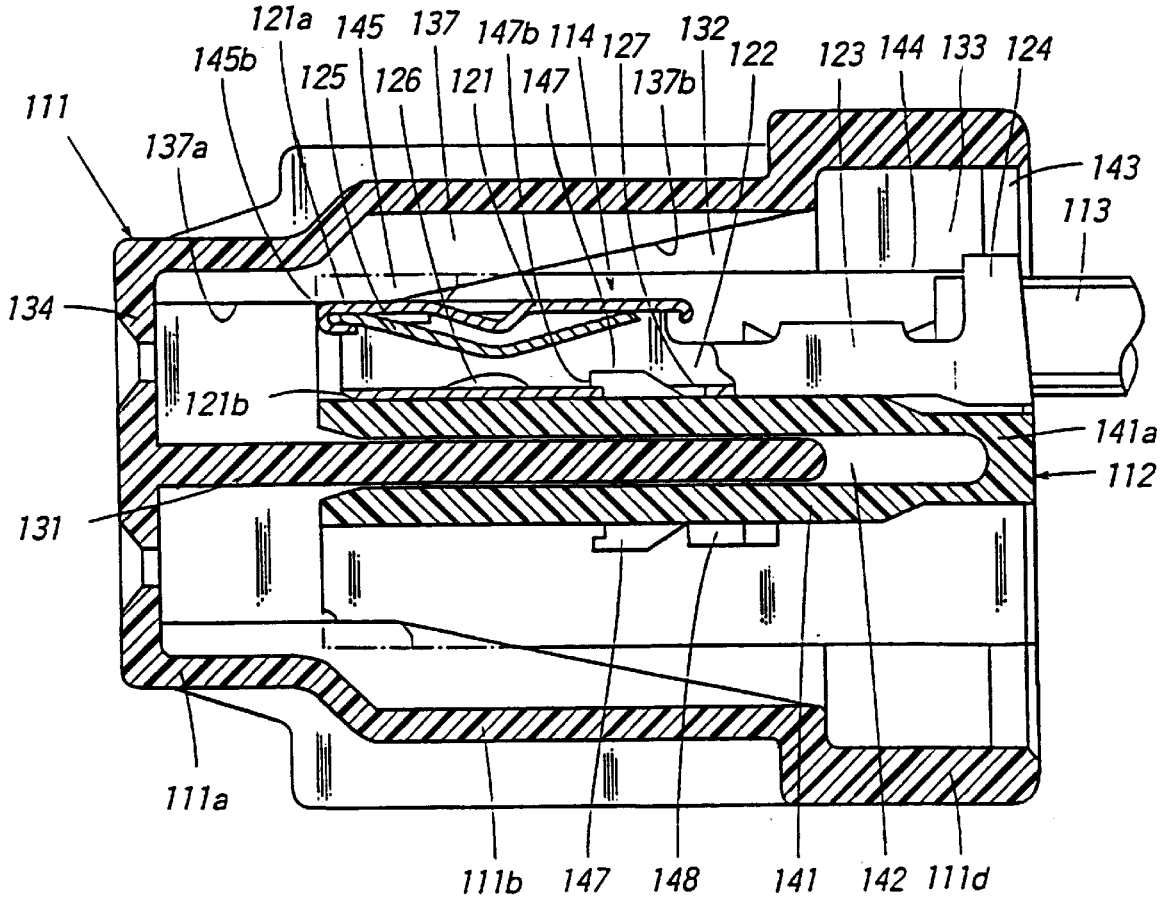
FIG. 31 is a vertical cross sectional view representing a condition in which the connecting terminal has been inserted into the provisionally engaged rear holder.

Then the connecting terminal 114 is moved toward the terminal supporting plate 141 into the horizontal position shown in FIG. 31, the bottom of the clad clamping portion 124 is urged against the rear supporting portion 141*a*, and at the same time the rear retaining portion 147 is inserted into the claw inserting hole 127 of the contacting terminal 114. In this condition, when the electric wire 113 is pulled backward, the bottom plate 121*a* of the front portion of the claw inserting hole 127 is engaged with the lower portion of the claw portion 147*b*, and thus the return and backward removal of the connecting terminal 114 are inhibited. At the same time, the connecting portion 122 of the connecting terminal 114 is inserted a space between the rear limiting projections 148, 149 while being guided by the inclined surfaces 48*a*, 49*a*, and thus the right and left movement of the contacting terminal 114 is prevented.

Next, by inserting the rear holder 112 into the housing from the above mentioned provisionally engaged position, the completely engaged position shown in FIG. 22 is attained, and the rear holder 112 is retained within the housing 111 by the rear holder retaining portions 136. In this manner, the electric connector is ready for usage. In this case, the front edge of the rear holder 112 is urged against the front outer wall 111*f* and the terminal connecting portion 121 of the connecting terminal 114 is held between the horizontal plane 137*a* of the terminal guide plate 137 and the terminal supporting plate 141.

In the fourth embodiment, the backward removal of the connecting terminal 114 can be positively prevented and a wiring operation can be improved, because in the provisionally engaged position of the rear holder 112, the connecting terminal 114 is prevented from being returned into the inclined position by means of the claw portion 147*b* of the rear retaining portion 147 in the provisionally engaged position. Moreover, a swinging movement of the terminal connecting portion 121 of the connecting terminal 114 can be prevented by the terminal guide plate 137, terminal supporting plate 141 and both side partitions 144, and further a right and left movement of the connecting portion 122 of the connecting terminal 114 can be avoided by the rear limiting projections 148, 149. In this manner, an electrical connection of the terminal 114 can be attained positively.

FIG. 32 is an exploded perspective view showing a housing 151 and a rear holder 152 of a fifth embodiment, and FIG. 33 is a cross sectional view depicting the rear holder 152 provisionally engaged with housing 151, in which the rear holder 152 is inserted into a rear portion of the housing 151 and connecting terminals 154 with electric wires 153 are accommodated in the housing 151. The connecting terminal 154 comprises a rectangular tubular terminal connecting portion 161 for connecting a counter terminal, a stabilizer 162 for stabilizing the connecting terminal 154, a core conductor clamping portion 163 for clamping a core conductor of the electric wire 153, and a clad clamping portion 164 for clamping a clad of the electric wire 153, said portions being arranged in this order viewed from the front side. In an inner surface of a top of the terminal connecting portion 161, there are formed a projection 165 and a backward projection 166.

The housing 151 is formed to be symmetrical vertically as well as horizontally except for a locking mechanism 171 which is provided on a top surface for locking a housing of a counter electric connector. Within the housing 151 there are formed a number of terminal receiving chambers 173 defined by partition strips 172, said chambers being divided into upper and lower rows. At a middle of a partition strip 172 there is formed a slit 174 whose front portion constitutes an upper-lower partition 175 which divides a front portion of a terminal receiving chamber 173 into upper and lower portions. At a front end of a terminal receiving chamber 173 there is formed a front projection 176 which restricts the forward movement of the connecting terminal 154, and at a rear edge of the upper-lower partition 175 there is formed a thinned portion 175*a*.

A distance between adjacent partition strips 172 is determined such that a right and left movement of the connecting terminal 154 is prevented, and a height of a front top wall 177 is determined such that an up and down movement of the connecting terminal 154 is prevented. A middle top wall 178 extending from the front top wall 177 has a flexibility and is formed as a resilient thin plate having a slit for respective terminal receiving chambers 173, and is bent outwardly. The slit serves to bend the middle top wall 178 easily.

A height of a rear top wall 179 extending from the middle top wall 178 is sufficiently larger than a height of the front top wall 177, and further an inclined surface 179*a* is formed at a rear portion so that a height of the rear top wall becomes further larger toward the rear end. Between the outermost partition strips 172*a* and side walls 180 there are formed spaces 181, and in the side wall 180 there are formed a guide window 182 for guiding a guide projection of the rear holder 152 and a locking recess 183 for guiding a locking projection of the rear holder 152 also as will be explained later.

The rear holder 152 comprises right and left side plates 191 which are inserted into the spaces 181 of the housing 151, a connecting plate 192 which connects said side plates 191 with each other and is inserted into the slit 174 of the housing 151. In the front edge of the connecting plate 192, there are formed edge depressed portions 192*a* into which the thinned portions 175*a* of the up-down partition 175 are inserted and upper depressed portions 192*b* into which the projections 165 of the connecting terminals 154 are inserted. On an outer surface of the side plate 191 there are formed a locking projection 193 which is to be inserted into the locking recess 183 of the housing and a guide projection 194 which is to be inserted into the guide window 182 of the housing 151.

Furthermore, in upper and lower surfaces of the connecting plate 192, there are formed rear retaining portions 195 which are inserted into the terminal receiving chambers 173 of the housing 151 to retain the connecting terminals in position. A front end face of the rear retaining portion 195 is formed as a front retaining surface 195*a* which retains the rear portion of the terminal connecting portion 161 of the connecting terminal 154, and in this front retaining surface 195*a* there is formed a groove 195*b* into which the backward projection 166 of the connecting terminal 154. A top surface of a rear portion of the rear retaining portion 195 is formed as an inclined surface 195*c*, In both side surfaces of the rear portion of the rear retaining portion 195 there are formed guide recesses 195*d* for guiding the stabilizer strips 162, and a front wall of the guide recess 195*d* is formed as a rear retaining surface 195*e* which retains the front edge of the stabilizer strip 162. In a free condition, a distance between an inner surface of the middle top wall 178 and the rear retaining portion 195 of the rear holder in the provisionally engaged position is determined such that the terminal connecting portion 161 of the connecting terminal 154 can pass between the middle top wall 178 and the rear retaining portion 195, while the middle top wall is bent outwardly.

The housing 151 and rear holder 152 thus constructed are engaged with each other in the provisionally engaged position in which the rear holder is inserted into the housing halfway, and in the completely engaged position in which the rear holder has been fully inserted into the housing.

When a connecting terminal 154 is to be inserted into the housing 151, as illustrated in FIG. 33, and the rear holder 152 is in the provisionally engaged position, the connecting terminal 154 is pushed into the terminal receiving chamber 173 in an inclined fashion. In this case, the side plates 191 of the rear holder 152 are inserted into the spaces 181 of the housing 151 and the locking projections 193 and guide projections 194 of the rear holder 152 are inserted into the spaces 181 and guide windows 182 of the housing 151, respectively. In the completely engaged position of the rear holder 152, the guide projections 194 are urged against the front walls of the guide windows 182 and the locking projections 193 are engaged with the locking recesses 183.

Figure 34:
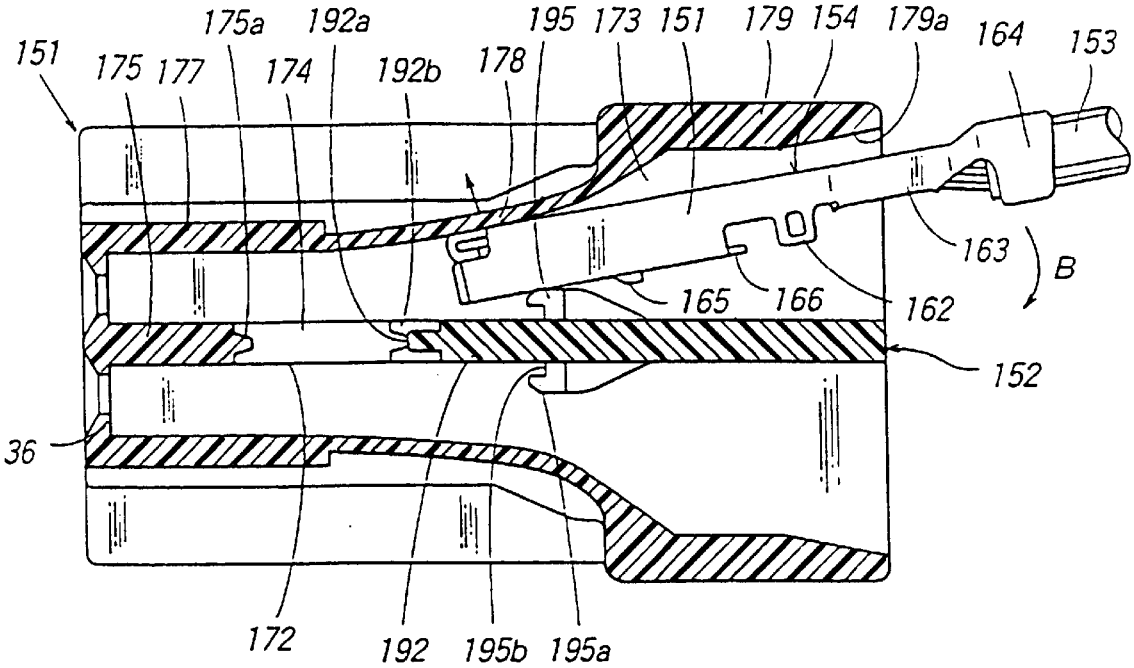
FIG. 34 is a vertical cross sectional view depicting a condition in which the connecting terminal is further inserted into the provisionally engaged rear holder.

In accordance with the insertion of the connecting terminal 154, the middle top wall 178 is bent outwardly as illustrated in FIG. 34 and the terminal connecting portion 161 is inserted between the middle top wall 178 and the rear retaining portion 195. Then, the front edge of the connecting terminal 154 is urged against the up and down partition 175 so that the forward movement of the connecting terminal 154 is stopped. At this time, backward projection 166 of the connecting terminal 154 has passed over the rear retaining portion 195. In this condition, when the connecting terminal 154 is kept in a free state, the middle top wall 178 is restored and the rear portion of the connecting terminal 154 is moved in a direction B and the connecting terminal is driven into the horizontal position.

Figure 35:
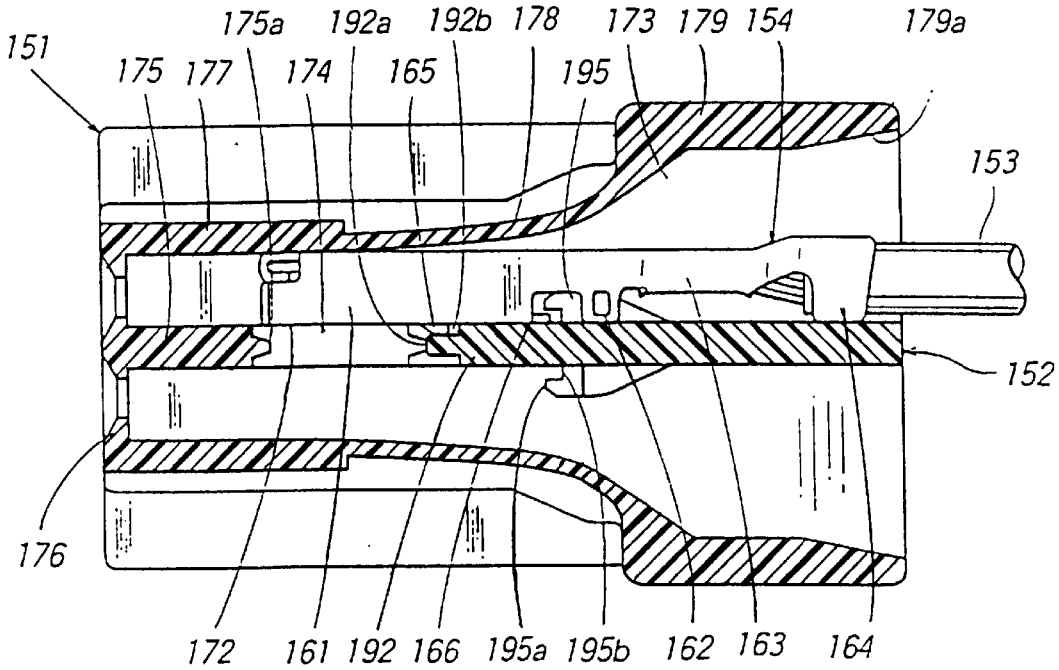
FIG. 35 is a vertical cross sectional view showing a condition in which the connecting terminal has been installed in the provisionally engaged rear holder.

Then, the projection 165 of the connecting terminal 154 is inserted into the upper depressed portion 192*b* of the rear holder 152 and the backward projection 166 of the connecting terminal 154 comes in front of the groove 195*b* as depicted in FIG. 35, so that the connecting terminal 154 could not be removed from the terminal receiving chamber 173. Since the middle top wall 178 has returned into the original position, the connecting terminal 154 could not be easily returned into the inclined position. It should be noted that when the connecting terminal 154 is pulled backward in the condition, the backward projection 166 is inserted into the groove 195*b*, and thus the connecting terminal could not be returned into the inclined position.

Figure 36:
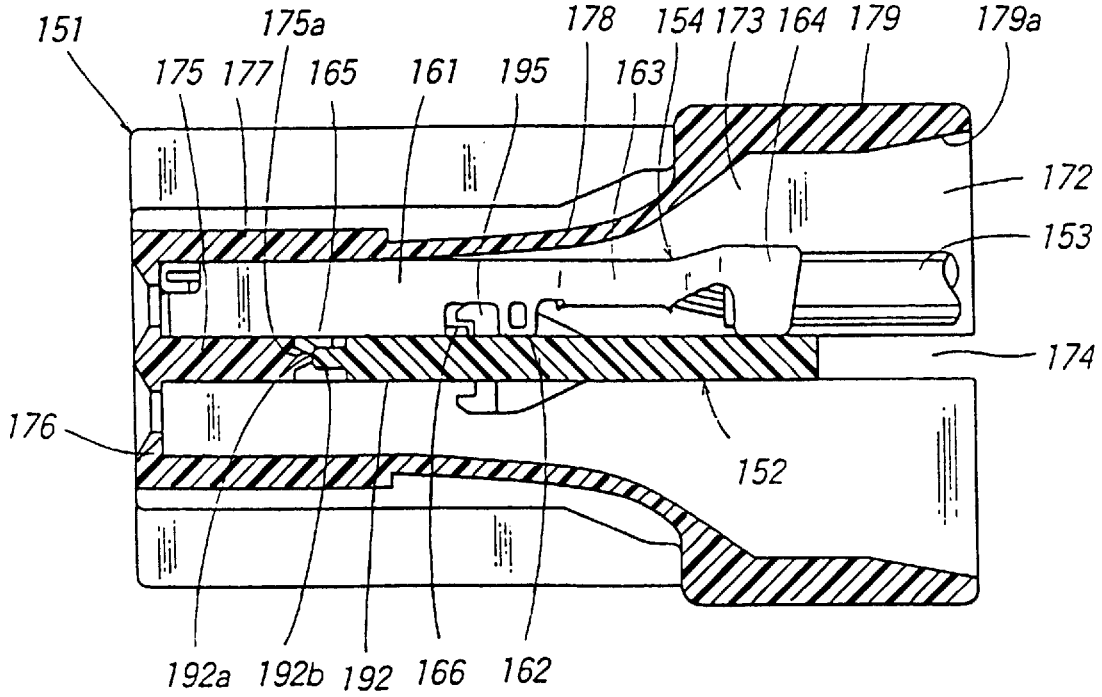
FIG. 36 is a cross sectional view depicting the rear holder which has been completely engaged with the housing.

Next, when the rear holder 152 is further inserted into the housing 151, the rear holder 152 is moved into the completely engaged position as shown in FIG. 36, in which the terminal connecting portion 161 is clamped between the up and down partition 175 and the front top wall 177 and the front edge of the terminal connecting portion 161 is urged against the front projection 176. Further, the thinned portions 175*a* of the housing 151 is inserted into the edge depressed portions 192*a* of the rear holder 152, the guide projection 194 of the rear holder 152 is urged against the front wall of the guide window 182, and the locking projection 194 of the rear holder 152 is inserted into the locking recess 183.

In the fifth embodiment, the middle top wall 178 of the housing 151 has a resiliency such that in the provisionally engaged position of the rear holder 152, the middle top wall 178 is bent outwardly and the terminal connecting portion 161 of the inclined connecting terminal 154 is inserted between the middle top wall and the rear retaining portion 195 of the rear holder 152, and after the connecting terminal 154 has advanced into the given position, the connecting terminal 154 is moved into the horizontal position due to the restoring of the middle top wall 178 and the terminal connecting portion 161 can be retained by the rear retaining portion 195.

Figure 37:
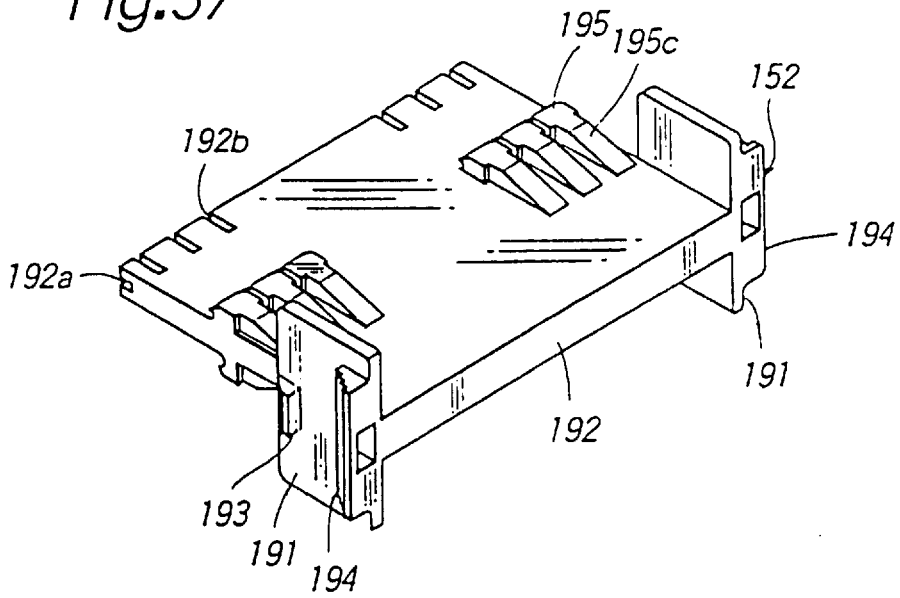
FIG. 37 is a perspective view showing a rear holder in a modified embodiment.
Figure 38:
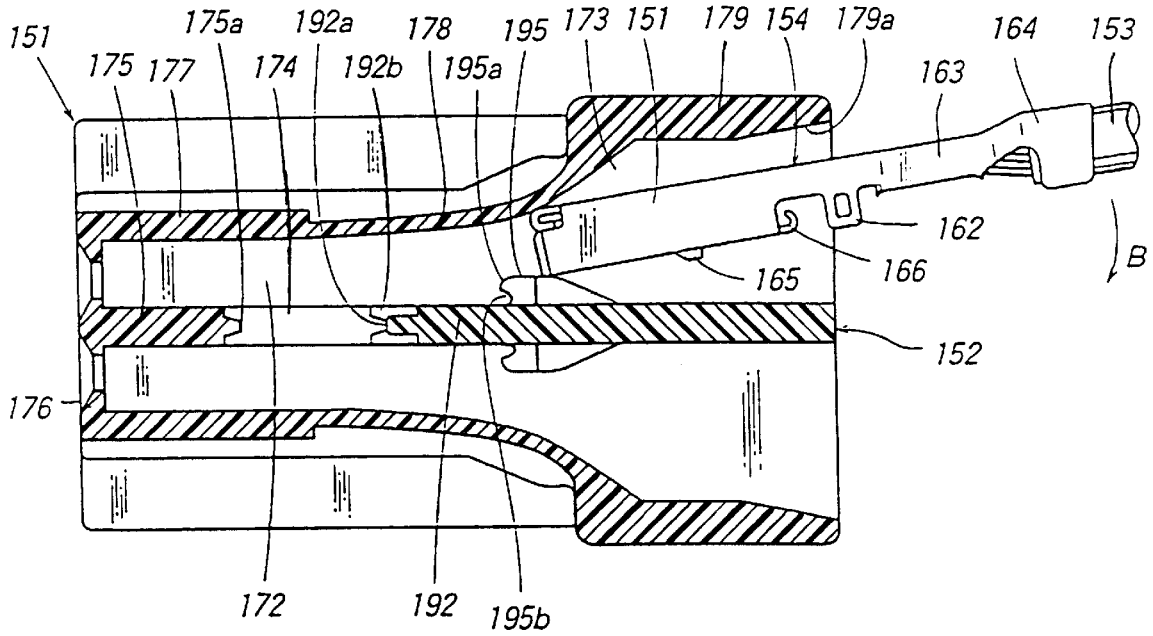
FIG. 38 is a vertical cross sectional view depicting a condition in which a connecting terminal is inserted into the provisionally engaged rear holder.

FIG. 37 shows a modification of the fifth embodiment, in which a shape of the rear retaining portion 195 of the rear holder 152 differs from that of the rear holder 152 shown in FIG. 32. FIG. 38 is a cross sectional view illustrating a condition in which the rear holder 152 is inserted into the housing 151 in the provisionally engaged position.

Figure 39:
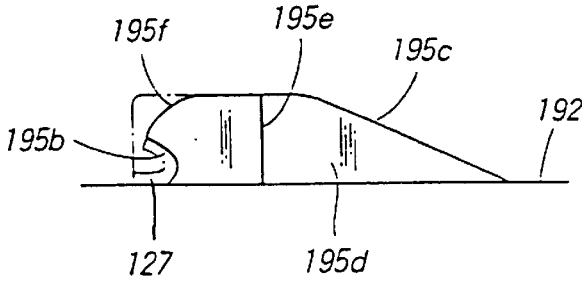
FIG. 39 is an enlarged side view showing a rear retaining portion of the rear holder.

As depicted in a partially enlarged view of FIG. 39, the front edge surface of the rear retaining portion 195 is formed as a curved surface 195*f* along which a round backward projection 167 of the connecting terminal 154 slides forward and downward, and below the curved surface 195*f* there is formed a retaining groove 195*b* for retaining the backward projection 167.

Figure 40:
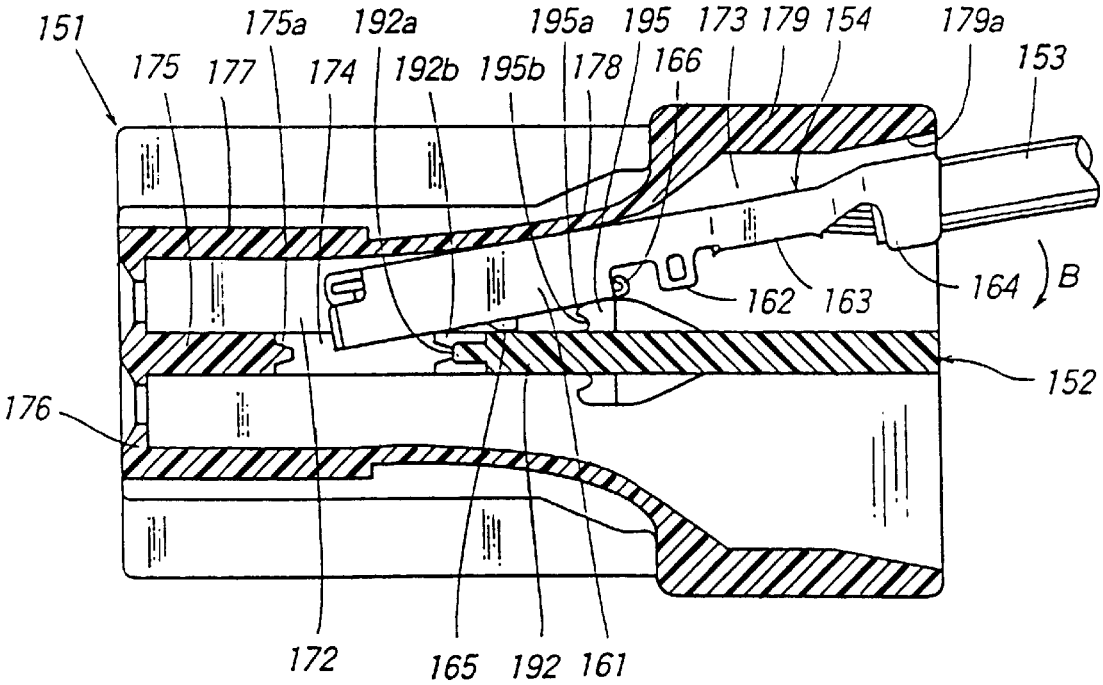
FIG. 40 is a vertical cross sectional view illustrating a condition in which a connecting terminal is inserted into the provisionally engaged rear holder.

When the connecting terminal 154 is to be inserted into the housing 151, like as the previous embodiment, the connecting terminal 154 is pushed into a terminal receiving chamber 173 in an inclined fashion while the rear holder 152 is in the provisionally engaged position shown in FIG. 38. In accordance with the insertion of the connecting terminal 154, the terminal connecting portion 161 is accommodated between the middle top wall 178 and the rear retaining portion 195 while the middle top wall 178 is bent outwardly as shown in FIG. 40.

Figure 41:
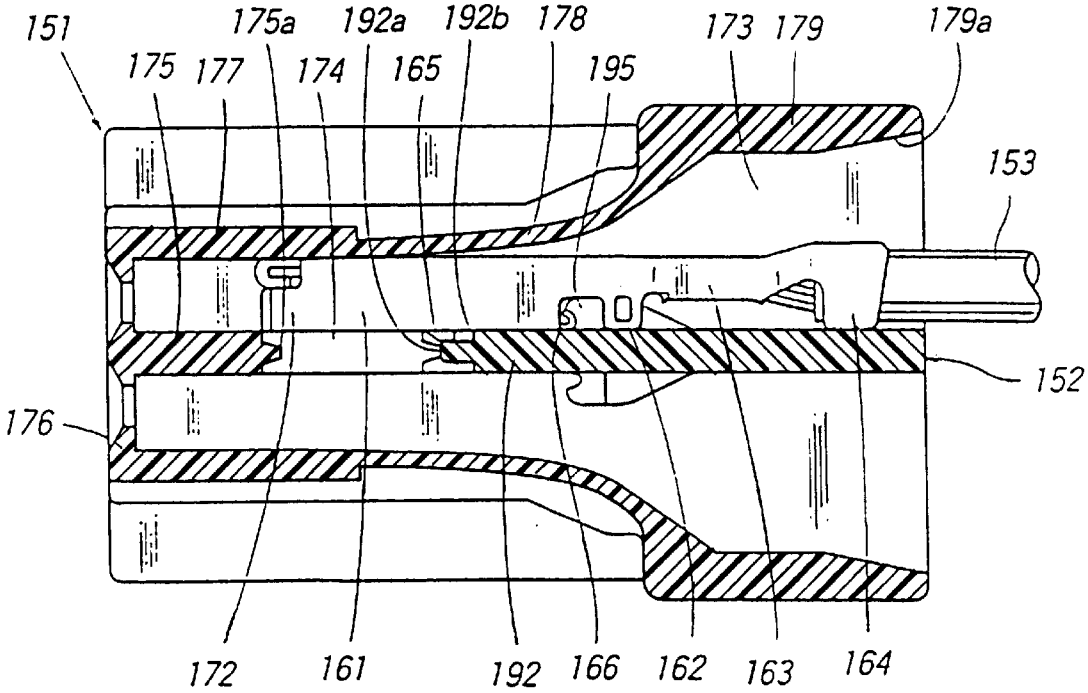
FIG. 41 is a vertical cross sectional view showing a condition in which the connecting terminal has been installed in the provisionally engaged rear holder.

When the backward projection 166 of the connecting terminal 154 comes above the curved surface 195*f* of the rear retaining portion 195, the middle top wall 178 is restored so that the connecting terminal 154 is pushed downward and the backward projection 166 is slid forward and downward. Then, a natural feeling of pushing can be obtained upon the insertion, and the rear portion of the connecting terminal 154 is moved in a direction B and the connecting terminal 154 comes into the horizontal position as shown in FIG. 41. From this position, the rear holder 152 is sufficiently pushed into the housing 151, and the rear holder 152 is moved into the completely engaged position.

Figure 42:
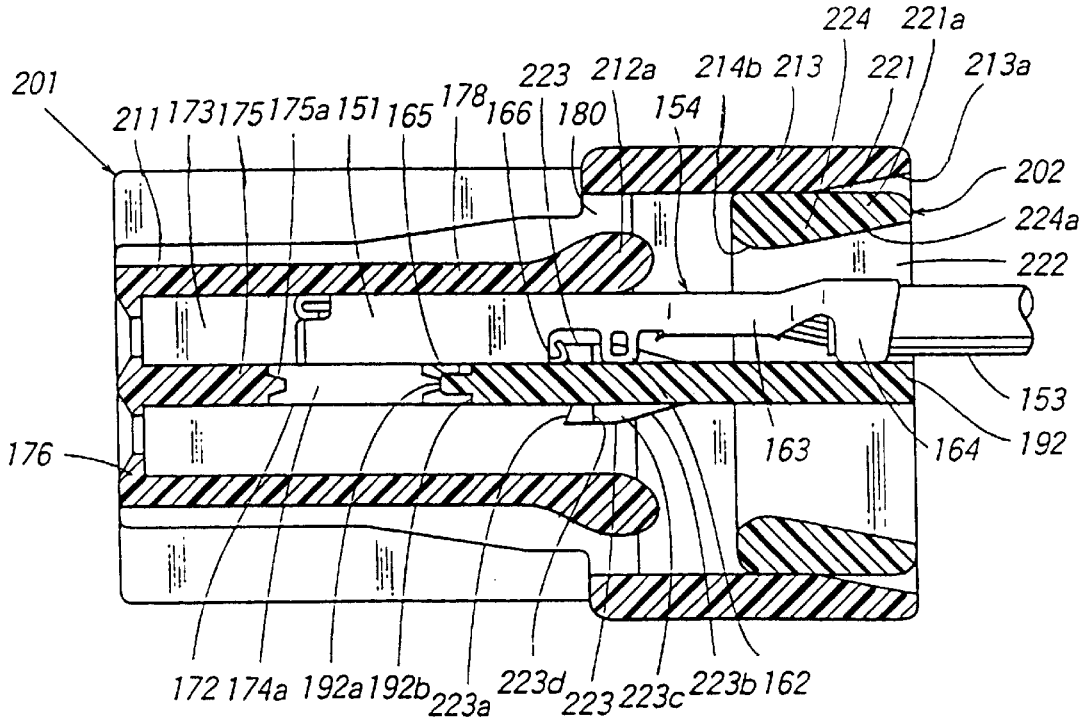
FIG. 42 is a vertical cross sectional view showing a condition in which a connecting terminal is inserted into a provisionally engaged rear holder in a sixth embodiment.

FIG. 42 is a cross sectional view showing a rear holder 202 provisionally engaged with a housing 201 of a sixth embodiment, in which the rear holder 202 is fitted into the rear portion of the housing 201 and connecting terminals 154 similar to those of the modification of the fifth embodiment. It should be noted that portions similar to those of the sixth embodiment are denoted by the same reference numerals used in the fifth embodiment.

A middle top wall 212 extending from a front top wall 211 has a flexibility and can be easily bent for respective terminal receiving chambers 173 by virtue of slits, said middle top wall being formed by a resilient plate whose rear portion constitutes a free end 212*a*. This free end 212*a* is formed thick to define a somewhat expanded opening. A height of a rear top wall 213 is determined such that a space 214 is formed between the free end 212*a* of the middle top wall 212 and a front portion of the rear top wall 213, and an inclined surface 214*a* is formed at a rear portion of an inner surface of the rear top wall 213, said inclined surface ascending viewed in the backward direction.

On upper and lower surfaces of a connecting plate 192, there are formed tubular portions 221 which are inserted into the rear portion of the housing 201, and a terminal inserting hole 222 through which connecting terminals 154 pass is formed within the tubular portion 221. The tubular portion 221 is formed symmetrically vertically and horizontally except for a locking mechanism 171 of the housing 201.

On upper and lower surfaces of the connecting plate 192 there are formed rear retaining portions 223 for retaining the terminal connecting portions 161 of the connecting terminals 154. At a front edge of a rear retaining portion 223, there is formed a front retaining surface 223*a* for retaining a backward projection 166 of a connecting terminal 154, and said front retaining surface 223*a* is inclined such that a root portion is retarded backward. A top surface of a rear portion of the rear retaining portion 223 is formed as an inclined surface 223*b*, and in both side surfaces of the rear portion of the rear retaining portion 223 there are formed guide recesses 223*c* for guiding stabilizer strips 162. A front wall of the guide recess 223*c* is formed as a rear retaining surface 223*d* for retaining a front edge of a stabilizer strip 162. In a free condition, the middle top wall 212 is resiliently bent such that the free end 212*a* of the middle top wall 212 is moved into the outer space 214, and a terminal connection portion 161 of a connecting terminal 154 is inserted between the middle top wall 212 and the rear retaining portion 223.

On a top plate 221*a* of the tubular portion 221, there is formed a pressing projection 224 which presses an upper surface of the free end 212*a* of the middle top wall 212 in the provisionally engaged position, said pressing projection 224 situating between successive partition strips 172 inserted into the terminal passing hole 222. At a rear portion of the pressing projection 224 there is formed a guide surface 224*a* for guiding the connecting terminal 154 in the inclined fashion, and at a front portion of the pressing projection 224 there is formed a pressing surface 224*b* which is urged against the upper surface of the free end 212*a* of the middle top wall 212 in the completely engaged position.

Figure 43:
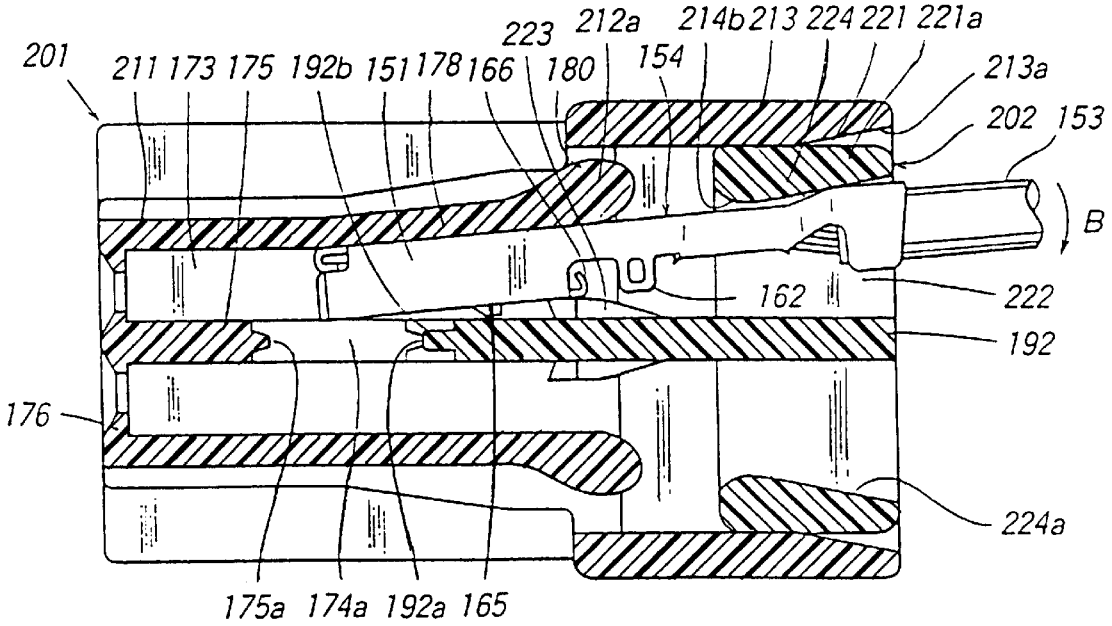
FIG. 43 is a vertical cross sectional view illustrating a condition in which the connecting terminal has been inserted into provisionally engaged rear holder.

In order to insert the connecting terminal 154 into the housing 201, the rear holder 202 is moved in the provisionally engaged position with respect to the housing 201 as shown in FIG. 43, and then the connecting terminal 154 is pushed into the terminal receiving chamber 173 in an inclined fashion. An upper surface of the connecting terminal 154 is urged against the guide surface 224*a* of the pressing projection 224 of the rear holder 202, and the free end 212*a* of the middle top wall 212 is moved outwardly into the space 214 so that the terminal connecting portion 161 is inserted between the free end 212*a* and the rear retaining portion 223. When the backward projection 166 of the connecting terminal 154 has just passed over the rear retaining portion 223, the connecting terminal 154 is released into a free state. Then, the middle top wall 212 is restored to move the rear portion of the connecting terminal 154 in a direction B, and the inclined connecting terminal 154 is driven into the horizontal state as shown in FIG. 42.

In this condition, the projection 165 of the connecting terminal 154 is inserted into the upper depressed portion 192*b*, the backward projection 166 situates in front of the front inclined surface 223*a* of the rear retaining portion 223, and the stabilizer strips 162 are inserted into the guide recesses 223*c*. Since the middle top wall 212 has been returned into the original position, the connecting terminal 154 could not be returned into the inclined position, and the connecting terminal 154 could not be removed from the terminal receiving chamber 173.

Figure 44:
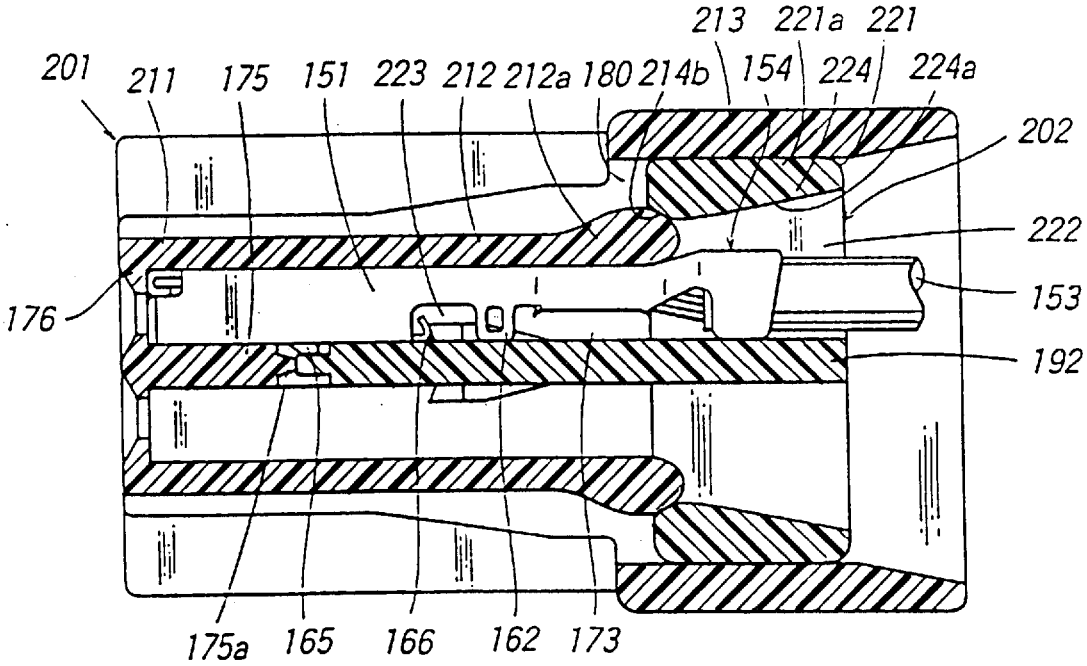
FIG. 44 is a cross sectional view depicting the connecting terminal which has been completely inserted.

Next, the rear holder 202 is further pushed into the housing 201 to attain the completely engaged position, as shown in FIG. 44. The terminal connecting portion 161 is clamped between the up and down partition 175 and the front top wall 211 and the front edge of the terminal connecting portion 161 is urged against the front projection 176. In this case, the thinned portion 175*a* of the housing 201 is inserted into the end face depressed portion 192*a* of the rear holder 202. The pressing surface 224*b* of the pressing projection 224 of the rear holder 202 urges against the upper surface of the free end 212*a* of the middle top wall 212.

Figure 45:
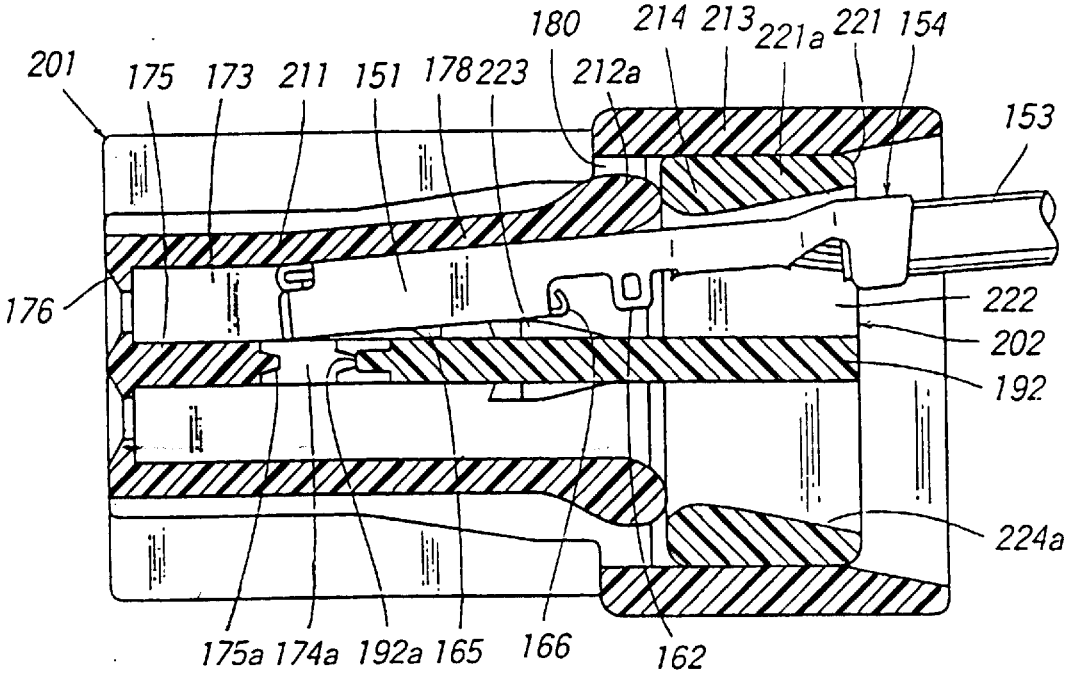
FIG. 45 is an explanatory view explaining an operation in a case in which a connecting terminal is incompletely inserted.

As depicted in FIG. 45, when the connecting terminal 154 is in an inclined position at which the connecting terminal does not pass over the rear retaining portion 223, the rear holder 202 could not be moved into the completely engaged position even if the rear holder 202 is further pushed into the housing, because the front surface of the pressing projection 224 is urged against the rear surface of the middle top wall 212.

In the manner explained above, in the sixth embodiment, the middle top wall 212 of the housing 201 has a flexibility and the terminal connecting portion 161 of the inclined connecting terminal 154 is inserted between the middle top wall 212 and the rear retaining portion 223 of the rear holder 202 while the free end 212*a* of the middle top wall 212 is moved into the space 214. Therefore, after the connecting terminal 154 has been inserted into a given position, the middle top wall 212 is restored to move the connecting terminal 154 into the horizontal position, and the terminal connecting portion 161 can be automatically retained by the rear retaining portion 223. In the completely engaged position of the rear holder 202, the upper surface of the free end 212*a* of the middle top wall 212 is pressed by the pressing projection 224, and thus a movement, particularly a swinging movement of the rear portion of the connecting terminal 154 can be positively prevented.

In the provisionally engaged position, the connecting terminal is pressed downward by the middle top wall 212 merely by inserting the connecting terminal 154 into a terminal receiving chamber 173, and therefore the connecting terminal 154 can be prevented from returning into the inclined position and the rear edge of the terminal connecting portion 161 of the connecting terminal 154 can be positively retained by the rear retaining portion 223. Moreover, the connecting terminal 154 can be driven into the horizontal position by the resilient force of the middle top wall 212, and thus a feeling of the insertion of the connecting terminal can be improved. Furthermore, when the connecting terminal 154 is in the inclined position, the rear holder 202 could not be pushed into the completely engaged position, and therefore the connecting terminal 154 can be prevented from being inserted erroneously.

Possibility of Industrial Utilization

As explained above, in the electric connector according to the invention, when the rear holder is in the provisionally engaged position, the connecting terminal is inserted in an inclined fashion. After the connecting terminal has been inserted into a predetermined position, the connecting terminal is moved into the horizontal position to be retained by the rear retaining portion. After that, the rear holder is moved into the completely engaged position and the backward removal of the connecting terminal is stopped. Therefore, it is no more necessary to provide the known retaining lance which has a rather poor reliability, the backward removal can be positively prevented, and a mold can be simple.

We claim:

1. An electric connector including a housing with a rear portion and a rear holder, said rear holder retaining therein a plurality of connecting terminals received in the housing from said rear portion thereof, said connecting terminals having a terminal connecting portion with a front end and a clamping portion;

said rear holder having connecting terminal supporting means for respectively supporting an entire length of said terminal connection portions including said front ends thereof, front retaining means for restricting forward movement of said connecting terminals, and rear retaining means for restricting backward movement of said connecting terminals, said housing having an inclined guide means for receiving and guiding a respective connecting terminal at an angle into said housing, said inclined guide means including an inclined guide surface extending upward from a front portion of said housing to said rear portion of said housing;

wherein said housing and said rear holder are constructed so that said connecting terminals are retained by said front retaining means in a provisionally engaged position by inserting said respective connecting terminal into the housing at an inclined position so that said connecting terminal abuts said inclined guide surface and then by moving said respective connecting terminal into a horizontal position, and said connecting terminals are fixed in position by pushing said rear holder into a completely engaged position where said front end of said terminal connecting portion abuts both said front retaining means and said housing.

2. An electric connector as claimed in claim 1, wherein said rear retaining means of the rear holder retains a middle portion of the connecting terminal.

3. An electric connector as claimed in claim 1, wherein said rear holder comprises a recess formed in a bottom thereof, and an electric wire fixing portion of the connecting terminal is fitted into said recess.

4. An electric connector as claimed in claim 1, wherein said rear holder comprises a vertical retaining means for preventing the connecting terminal from returning from the horizontal position into the inclined position.

5. An electric connector as claimed in claim 1, wherein said rear retaining means of the rear holder has formed, on both sides thereof, guide recesses for guiding mutually opposing stabilizer strips of the connecting terminal and front walls of said guide recesses are formed as front retaining portions for retaining front edges of said stabilizer strips.

6. An electric connector as claimed in claim 5, wherein said guide recess has formed, on a side wall thereof, a projection, and when said stabilizer strip is urged against said front retaining portion and said connecting terminal is in the horizontal position, said projection is inserted into a hole portion formed in the stabilizer strip.

7. An electric connector including a housing with a rear portion and a rear holder, said rear holder retaining connecting terminals therein and fitting into said housing from said rear portion of said housing, said housing and rear holder including means for providing a provisionally engaged position in which said rear holder is inserted halfway into said housing and a completely engaged position in which said rear holder is fully inserted into said housing, said rear holder including connecting terminal supporting means for respectively supporting an entire length of said connecting terminals, front retaining means for restricting forward movement of said connecting terminals, and rear retaining means for restricting backward movement of said connecting terminals, said connecting terminals respectively have a bottom with a hole means for receiving said rear retaining means, said housing having an inclined guide means for receiving and guiding a respective connecting terminal at an angle into said housing, said inclined guide means including an inclined guide surface extending upward from a front portion of said housing to said rear portion of said housing;

wherein said rear retaining means is fitted into said rear portion of connecting terminal in said provisionally engaged position by inserting said connecting terminal into said housing at an inclined position so that said connecting terminal abuts said inclined guide surface, and then by moving said connecting terminal into a horizontal position, and said connecting terminal is fixed by pushing said rear holder into said completely engaged position, where said front end of said terminal connecting portion abuts both said front retaining means and said housing and said hole means of said connecting terminal engages said rear retaining means of said rear holder.

8. An electric connector as claimed in claim 7, wherein said rear retaining portion of the rear holder is formed as a claw portion facing forward.

9. An electric connector as claimed in claim 7, wherein said rear holder comprises a supporting portion for supporting a reduced diameter portion of the connecting terminal.

* * * * *